US010730320B2

(12) United States Patent
Otsuka et al.

(10) Patent No.: US 10,730,320 B2
(45) Date of Patent: Aug. 4, 2020

(54) MEDIUM TRANSPORT DEVICE AND RECORDING APPARATUS

(71) Applicant: SEIKO EPSON CORPORATION, Tokyo (JP)

(72) Inventors: Kazuo Otsuka, Azumino (JP); Kazuhisa Takeda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/141,412

(22) Filed: Sep. 25, 2018

(65) Prior Publication Data

US 2019/0092048 A1 Mar. 28, 2019

(30) Foreign Application Priority Data

Sep. 28, 2017 (JP) ..... 2017-188565

(51) Int. Cl.
*B41J 11/00* (2006.01)
*B65H 29/52* (2006.01)
(Continued)

(52) U.S. Cl.
CPC ..... *B41J 11/007* (2013.01); *B41J 13/009* (2013.01); *B41J 13/106* (2013.01); *B65H 29/52* (2013.01);
(Continued)

(58) Field of Classification Search
CPC ..... B41J 11/007; B41J 13/106; B41J 13/009; B41J 2/01; B41J 13/0045; B41J 3/60; B65H 31/22; B65H 31/02; B65H 29/52; B65H 2407/21; B65H 2601/321; B65H 2801/15; B65H 2405/11151; B65H 2301/4212;
(Continued)

(56) References Cited

U.S. PATENT DOCUMENTS

2005/0047840 A1* 3/2005 Ohashi ..... B41J 13/0063 399/388
2015/0273892 A1* 10/2015 Tanjo ..... B41J 29/02 347/104
(Continued)

FOREIGN PATENT DOCUMENTS

JP 2008-290782 A 12/2008
JP 4495604 B 4/2010
(Continued)

*Primary Examiner* — Huan H Tran
*Assistant Examiner* — Alexander D Shenderov
(74) *Attorney, Agent, or Firm* — Workman Nydegger

(57) ABSTRACT

A medium transport device includes a first transport route for discharging a medium processed by a processing unit, a second transport route for discharging the medium processed by the processing unit, and a medium receiving tray that is capable of switching a state between a medium receiving state of receiving the medium that is discharged through the first transport route and a medium unreceivable state achieved by performing state switching from the medium receiving state. The first transport route comes into a non-formed state and at least a part of the medium receiving tray forms the second transport route when the medium receiving tray is in the medium unreceivable state, and the second transport route comes into the non-formed state and the first transport route is formed when the medium receiving tray comes into the medium receiving state.

20 Claims, 29 Drawing Sheets

(51) Int. Cl.

| | |
|---|---|
| ***B65H 31/02*** | (2006.01) |
| ***B41J 13/10*** | (2006.01) |
| ***B65H 31/22*** | (2006.01) |
| ***B41J 13/00*** | (2006.01) |

(52) U.S. Cl.
CPC ..... *B65H 31/02* (2013.01); *B65H 31/22* (2013.01); *B65H 2301/4212* (2013.01); *B65H 2402/45* (2013.01); *B65H 2404/63* (2013.01); *B65H 2405/11151* (2013.01); *B65H 2405/11164* (2013.01); *B65H 2405/111646* (2013.01); *B65H 2405/324* (2013.01); *B65H 2407/21* (2013.01); *B65H 2601/11* (2013.01); *B65H 2601/321* (2013.01); *B65H 2801/15* (2013.01)

(58) Field of Classification Search
CPC .... B65H 2405/324; B65H 2405/11164; B65H 2405/111646; B65H 2404/63; B65H 2601/11; B65H 2402/45; B65H 2701/1131; B65H 2801/03; B65H 29/22
USPC ..... 347/104
See application file for complete search history.

(56) References Cited

U.S. PATENT DOCUMENTS

2015/0338786 A1 11/2015 Sawada et al.
2016/0288534 A1* 10/2016 Hirata ..... B41J 11/007

FOREIGN PATENT DOCUMENTS

JP 2016-000643 A 1/2016
JP 5954595 B 6/2016

* cited by examiner

MEDIUM TRANSPORT DEVICE AND RECORDING APPARATUS

BACKGROUND

1. Technical Field

The present invention relates to a medium transport device that transports a medium and a recording apparatus including the medium transport device.

2. Related Art

A facsimile, a printer, or the like as an example of a recording apparatus includes a plurality of transport routes, in some cases. For example, a recording apparatus may include a route (paper feeding route) for transporting a sheet of paper from a feed cassette to a recording unit, a transport route (face-up route) for discharging a sheet with the latest recording surface facing upward, and a transport route for discharging the sheet with the latest recording surface facing downward.

In particular, in a configuration in which the transport route for discharging a sheet of paper, on which recording is performed, is switched, a switching member that switches the transport routes is provided at a divergence position of the transport routes.

JP-A-2016-643 discloses an image forming apparatus that includes a face-up route and a face-down route in which the two routes are switched by using two switching members (route members 71A and 71B in JP-A-2016-643).

The switching member that switches the transport routes has a configuration in which a state of falling down due to its own weight depending on circumstances is a usual state and, in this state, a sheet of paper changes a posture (pushes up) the switching member against the own weight of the switching member. However, a use of the switching member results in an increase in cost and an increase in size of the apparatus.

SUMMARY

An advantage of some aspects of the invention is to realize switching of transport routes, with an increase in cost and an increase in size of an apparatus being suppressed.

According to an aspect of the invention, there is provided a medium transport device including: a first transport route for discharging a medium processed by a processing unit, with a first surface facing upward; a second transport route for discharging the medium processed by the processing unit, with the first surface facing downward; and a medium receiving tray that is capable of switching a state between a medium receiving state of receiving the medium that is discharged, with the first surface facing downward, through at least a part of the first transport route and a medium unreceivable state achieved by performing state switching from the medium receiving state. The first transport route comes into the non-formed state and at least a part of the medium receiving tray forms the second transport route when the medium receiving tray is in the medium unreceivable state, and the second transport route comes into the non-formed state and the first transport route is formed when the medium receiving tray comes into the medium receiving state.

In this configuration, the state of the medium receiving tray is switched, and thereby it is possible to switch the state between non-forming of the first transport route and forming of the second transport route and non-forming of the second transport route and forming of the first transport route, that is, the medium receiving tray is used as a route switching member. In this manner, it is possible to realize the switching of the transport route, with an increase in cost and an increase in size of the apparatus being suppressed.

A "non-formed state" of the transport route means a state in which the transport route is not completely formed and it is not possible to transport the medium.

In the medium transport device, rotation of the medium receiving tray may cause a state to be switched between the medium unreceivable state and the medium receiving state.

In this configuration, the rotation of the medium receiving tray causes the state to be switched between the medium unreceivable state and the medium receiving state, and thus operation effects described above are achieved.

In the medium transport device, the medium receiving tray may include at least one extension tray that causes a medium receiving surface, which receives the medium discharged through the first transport route, to be extended.

In this configuration, since the medium receiving tray includes at least one extension tray that causes the medium receiving surface, which receives the medium discharged through the first transport route, to be extended, it is possible to appropriately support a large-sized medium.

The medium transport device may further include an openable/closeable cover that is provided on a side surface of a housing in which the processing unit is provided. The medium receiving tray and at least a part of the second transport route to be exposed by opening of the cover.

In this configuration, the opening of the cover enables both of access to the medium receiving tray and access to the zone of the second transport route in which the medium is curved and inverted, and thus it is possible to easily perform unjamming work when a jam occurs.

In the medium transport device, the cover may be provided with a tray engaging portion that supports the medium receiving tray in the state in which the cover is in the closed state such that the medium unreceivable state of the medium receiving tray is maintained and pushes up the medium receiving tray which is in the medium receiving state when the cover is closed from the opened state such that the state is switched to the medium unreceivable state.

In this configuration, since the state of the medium receiving tray is switched in conjunction with an opening/closing operation of the cover, the operability by the user improves. In addition, since the tray engaging portion supports the medium receiving tray in the state in which the cover is closed, the medium unreceivable state of the medium receiving tray is reliably maintained.

The medium transport device may further include a cover state detector that detects an opened/closed state of the cover.

In this configuration, since the cover state detector that detects the opened/closed state of the cover is provided, the opened/closed state of the cover, that is, the state of the medium receiving tray, is found, and thereby it is possible to select an appropriate transport route.

In the medium transport device, a state to be switched between the medium unreceivable state and the medium receiving state by sliding of the medium receiving tray.

In this configuration, the state to be switched between the medium unreceivable state and the medium receiving state by sliding of the medium receiving tray, and thus operation effects described above are achieved.

In the medium transport device, the medium receiving tray may be provided with a projecting portion on a downstream side thereof, the projecting portion projecting from a support surface in the medium receiving tray, which supports the medium. The projecting portion may form the second transport route when the medium receiving tray comes into the medium unreceivable state.

In this configuration, the projecting portion provided on the medium receiving tray suppresses sliding off of the medium that is discharged to the medium receiving tray. When the medium receiving tray is in the medium unreceivable state, the projecting portion forms the second transport route, and thus it is possible to achieve a reduction in the number of members and suppressing of an increase in cost.

According to another aspect of the invention, there is provided a medium transport device including: a first transport route for discharging a medium processed by a processing unit; a second transport route for discharging a medium processed by a processing unit; a medium receiving tray that is capable of switching a state between a medium receiving state of receiving the medium that is discharged through the first transport route and a medium unreceivable state achieved by performing state switching from the medium receiving state; and a route forming member that enables a state to be switched between a first state in which the second transport route is formed and the first transport route comes into the non-formed state and a second state in which the first transport route is formed and the second transport route comes into the non-formed state. The route forming member is supported by the medium receiving tray and comes into the first state when the medium receiving tray is in the medium unreceivable state, and the route forming member is released from the support by the medium receiving tray and comes into the second state when the medium receiving tray is in the medium receiving state.

In this configuration, the state of the medium receiving tray is switched, and thereby the state of the route forming member is switched. Therefore, there is no need to provide a power source for operating the route forming member, and thereby it is possible to realize the switching of the transport route, with an increase in cost and an increase in size of the apparatus being suppressed.

The "non-formed state" of the transport route means a state in which the transport route is not completely formed and it is not possible to transport the medium.

The medium transport device may further include a tray state detector that detects a state of the medium receiving tray.

In this configuration, since the tray state detector that detects the state of the medium receiving tray is provided, the state of the medium receiving tray is found, and thereby it is possible to select an appropriate transport route.

According to still another aspect of the invention, there is provided a recording apparatus including: a recording unit as the processing unit, which performs recording on a medium; and the medium transport device described above.

In this configuration, operation effects described above are achieved in the recording apparatus that performs the recording on the medium.

In the recording apparatus, the first transport route may be a transport route through which the medium is discharged, with a first surface thereof facing upward without being curved or inverted, from the processing unit to an outer side of the housing, in which the processing unit is provided. The second transport route may be a transport route through which the medium processed by the processing unit is fed toward an upper side, is curved and inverted, and is discharged, with the first surface thereof facing downward, to the outer side of the housing.

In this configuration, the first transport route is the transport route through which the medium is discharged, with the first surface thereof facing upward without being curved or inverted, from the processing unit to the outer side of the housing, and the second transport route is the transport route through which the medium processed by the processing unit is fed toward the upper side, is curved and inverted, and is discharged, with the first surface thereof facing downward, to the outer side of the housing, and thus operation effects described above are achieved.

In the recording apparatus, the recording unit may include a liquid ejecting head that performs recording on the medium by ejecting a liquid. The recording apparatus may further include a liquid containing unit that is provided on a front surface which is one of side surfaces of the housing and contains the liquid that is ejected from the liquid ejecting head. The liquid containing unit and a zone of the second transport route, in which the medium is curved and inverted, may overlap each other by at least a part thereof in an apparatus depth direction.

In this configuration, the liquid containing unit is provided on the front surface which is one of the side surfaces of the housing and contains the liquid that is ejected from the liquid ejecting head, and the liquid containing unit and the zone of the second transport route, in which the medium is curved and inverted, overlap each other by at least a part thereof in the apparatus depth direction. Therefore, it is possible to suppress a dimension in the apparatus depth direction.

The recording apparatus may further include a medium accommodating unit that is provided on a lower side of the first transport route and accommodates the medium; and a medium inverting unit that inverts the medium fed from the medium accommodating unit and transports the medium to the recording unit or inverts the medium, on which the recording is performed by the recording unit and which is fed back, and again transports the medium to the recording unit. The medium inverting unit may be provided to be close to a rear surface on a side opposite to the front surface which is one of the side surfaces of the housing.

In this configuration, operation effects described above are achieved in the recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. The same reference signs are assigned to the same configurations in Examples, thus only a first example is described, and description of the configurations in the other examples is omitted.

Figure 1:
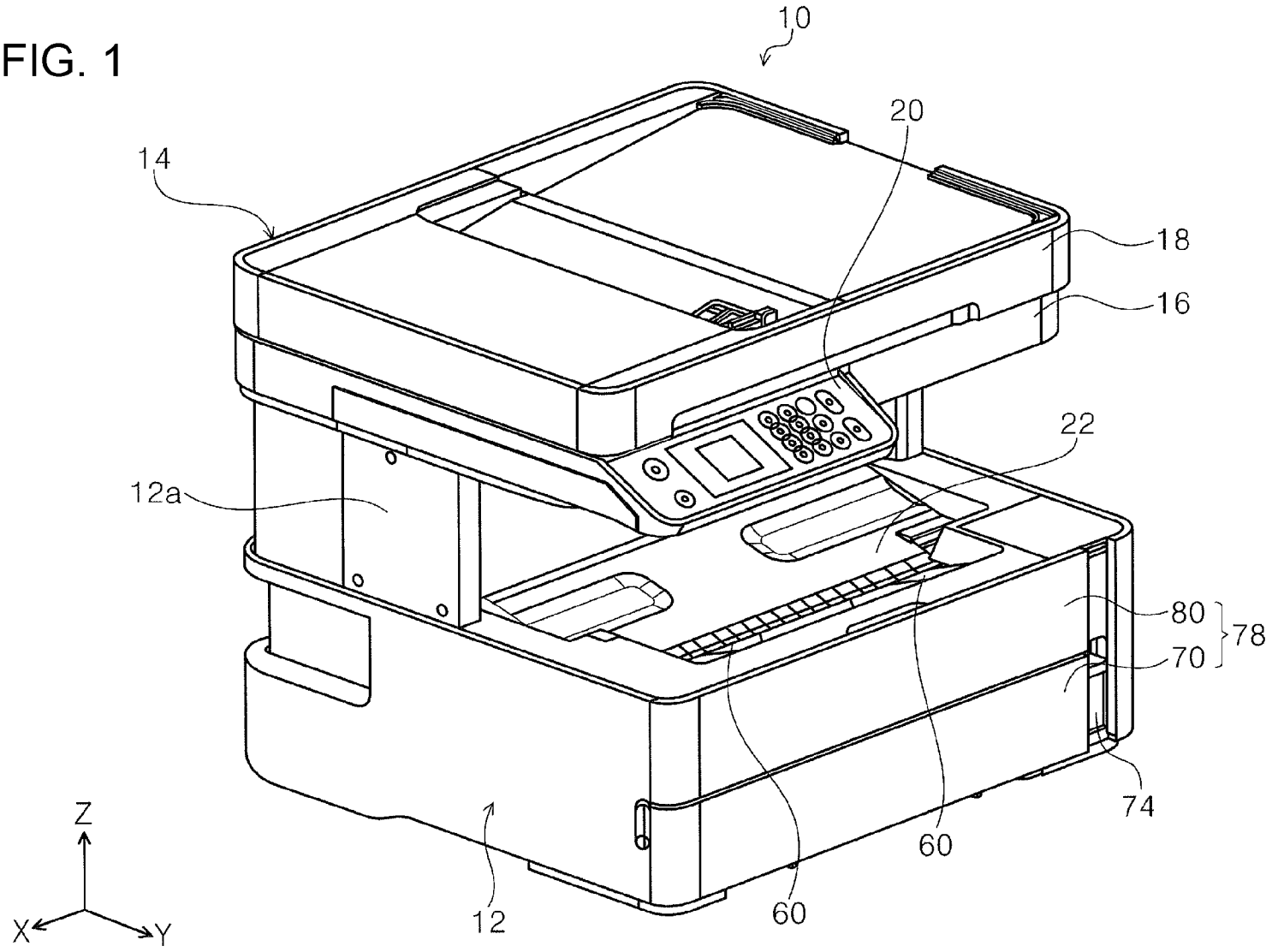
FIG. 1 is a perspective view illustrating the external appearance of a printer according to a first embodiment.
Figure 2:
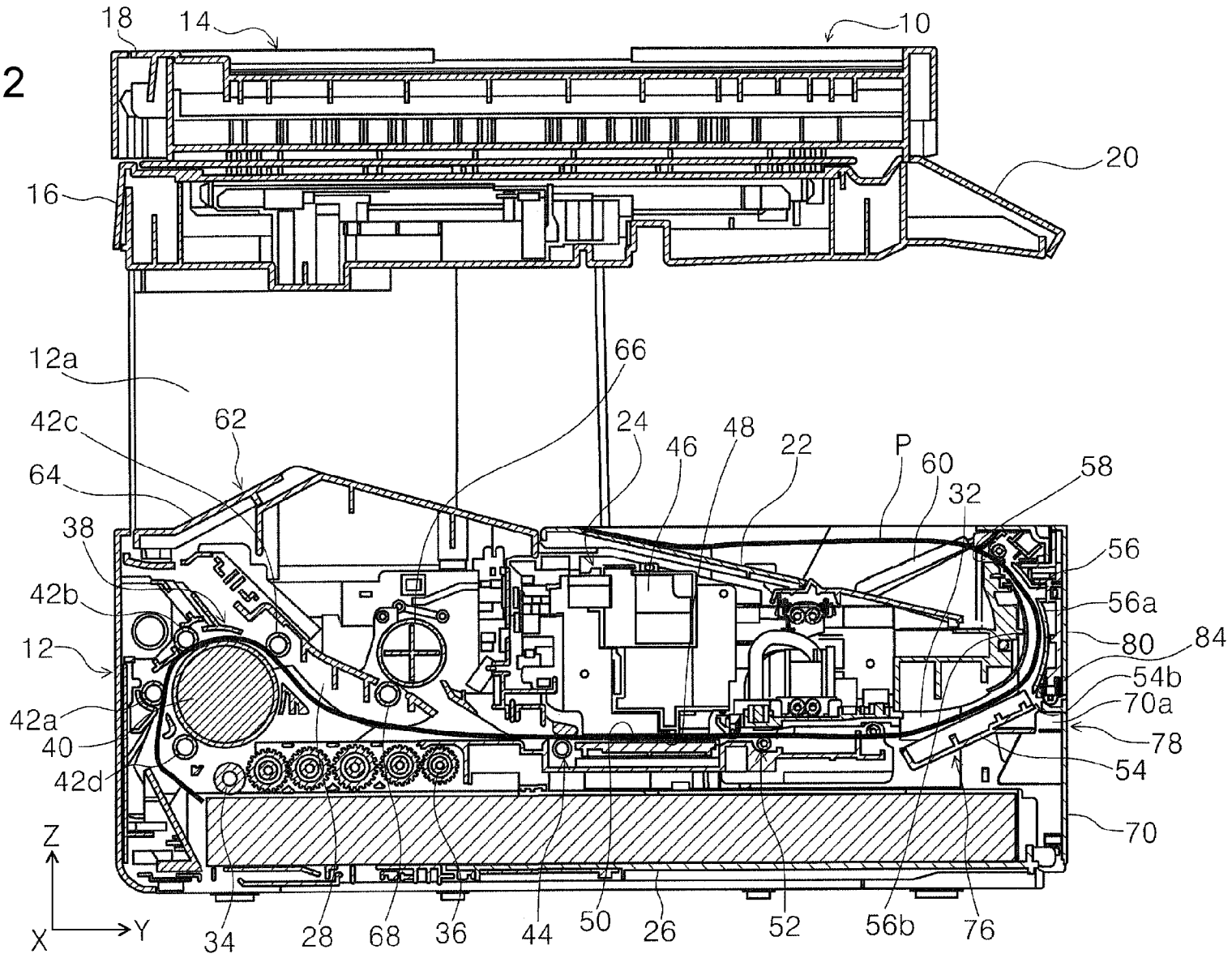
FIG. 2 is a sectional side view illustrating a transport route of a medium that is transported from a medium accommodating unit of the printer according to the first embodiment.
Figure 3:
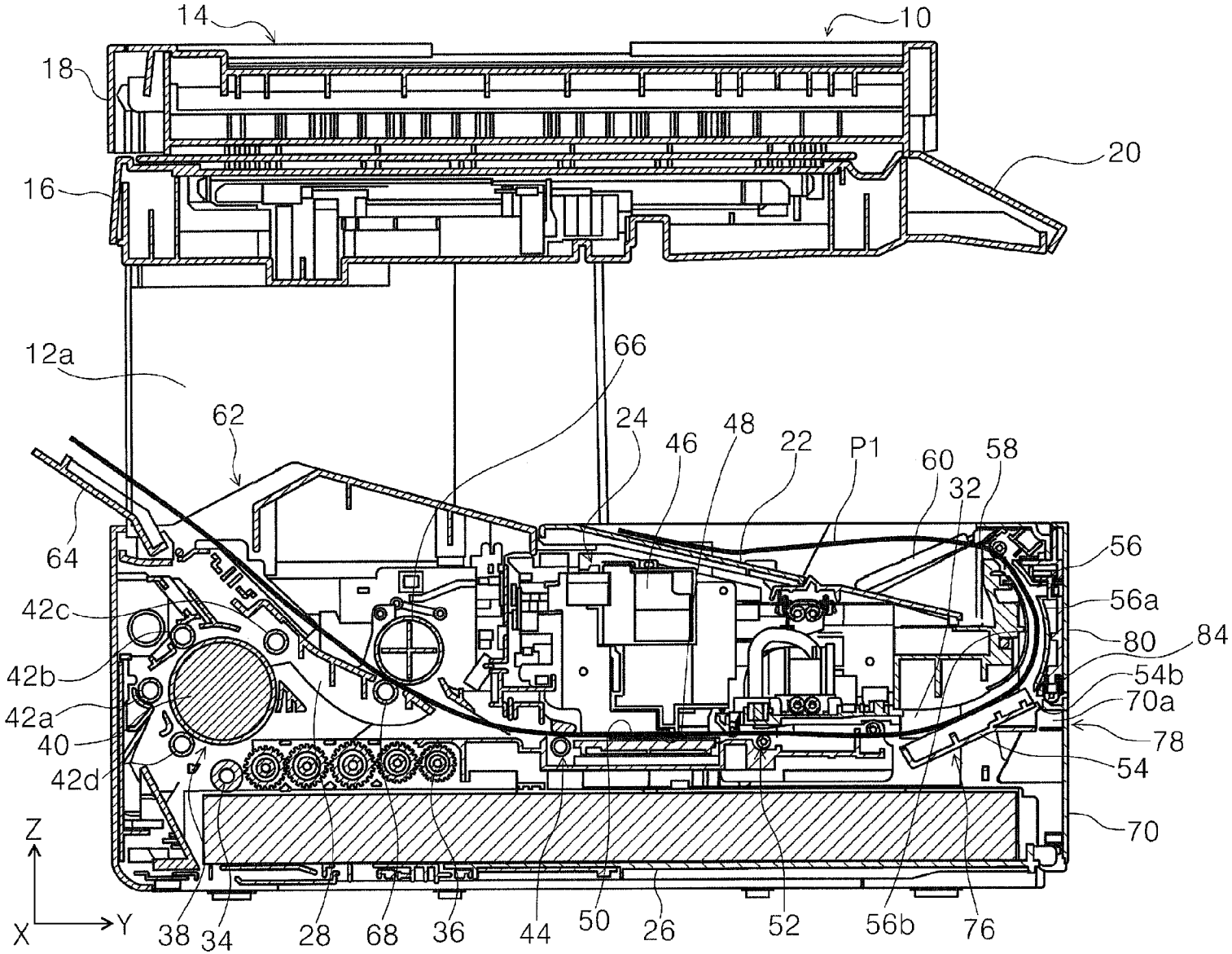
FIG. 3 is a sectional side view illustrating a transport route of a medium that is transported from a rear feed unit of the printer according to the first embodiment.
Figure 4:
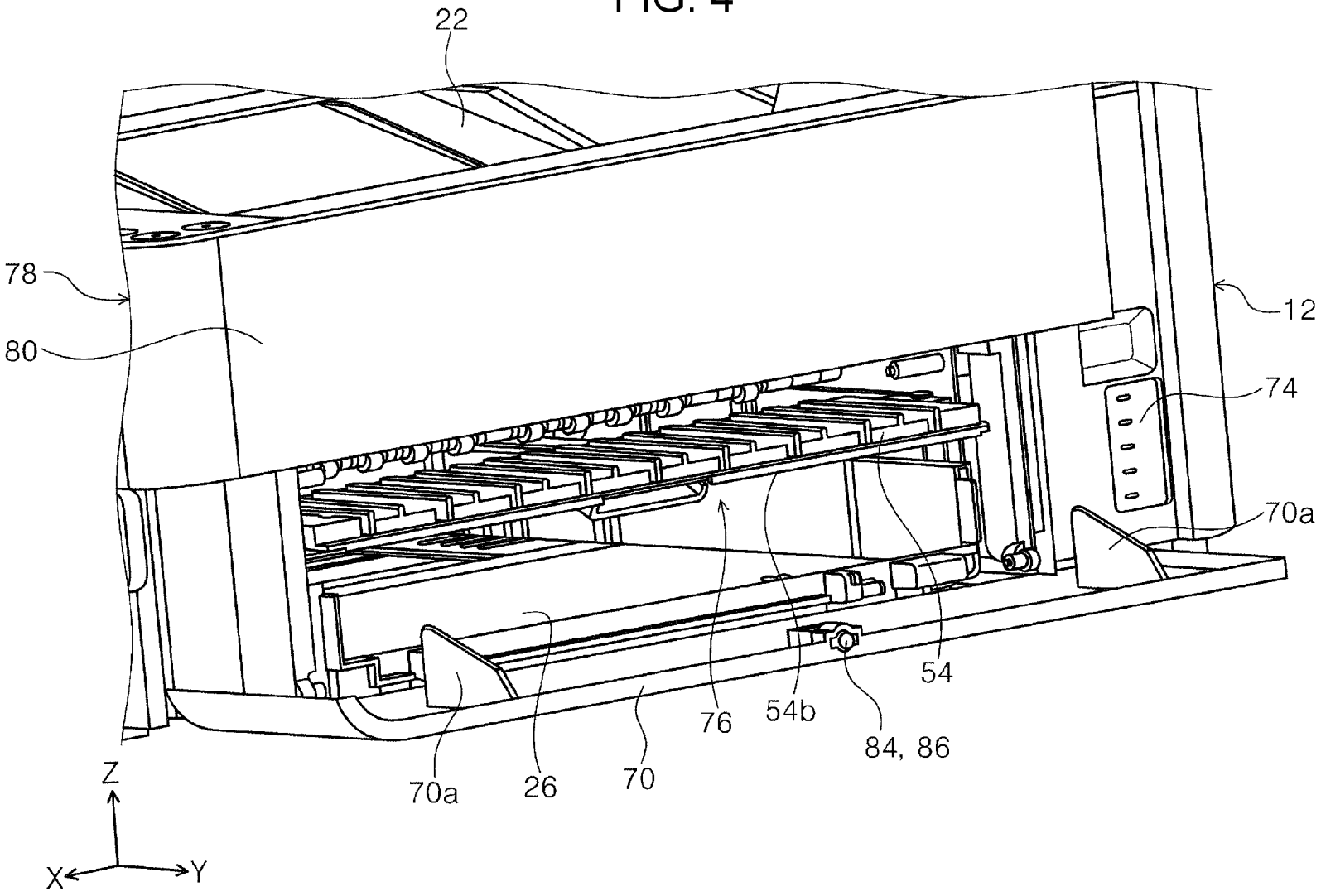
FIG. 4 is a perspective view illustrating a medium receiving tray which is in a medium receiving state of receiving a medium that is discharged through the first transport route in the printer according to the first embodiment.

FIG. 1 is a perspective view illustrating the external appearance of a printer according to a first embodiment. FIG. 2 is a sectional side view illustrating a transport route of a medium that is transported from a medium accommodating unit of the printer according to the first embodiment. FIG. 3 is a sectional side view illustrating a transport route of a medium that is transported from a rear feed unit of the printer according to the first embodiment. FIG. 4 is a perspective view illustrating a medium receiving tray which is in a medium receiving state of receiving a medium that is discharged through the first transport route in the printer according to the first embodiment.

Figure 5:
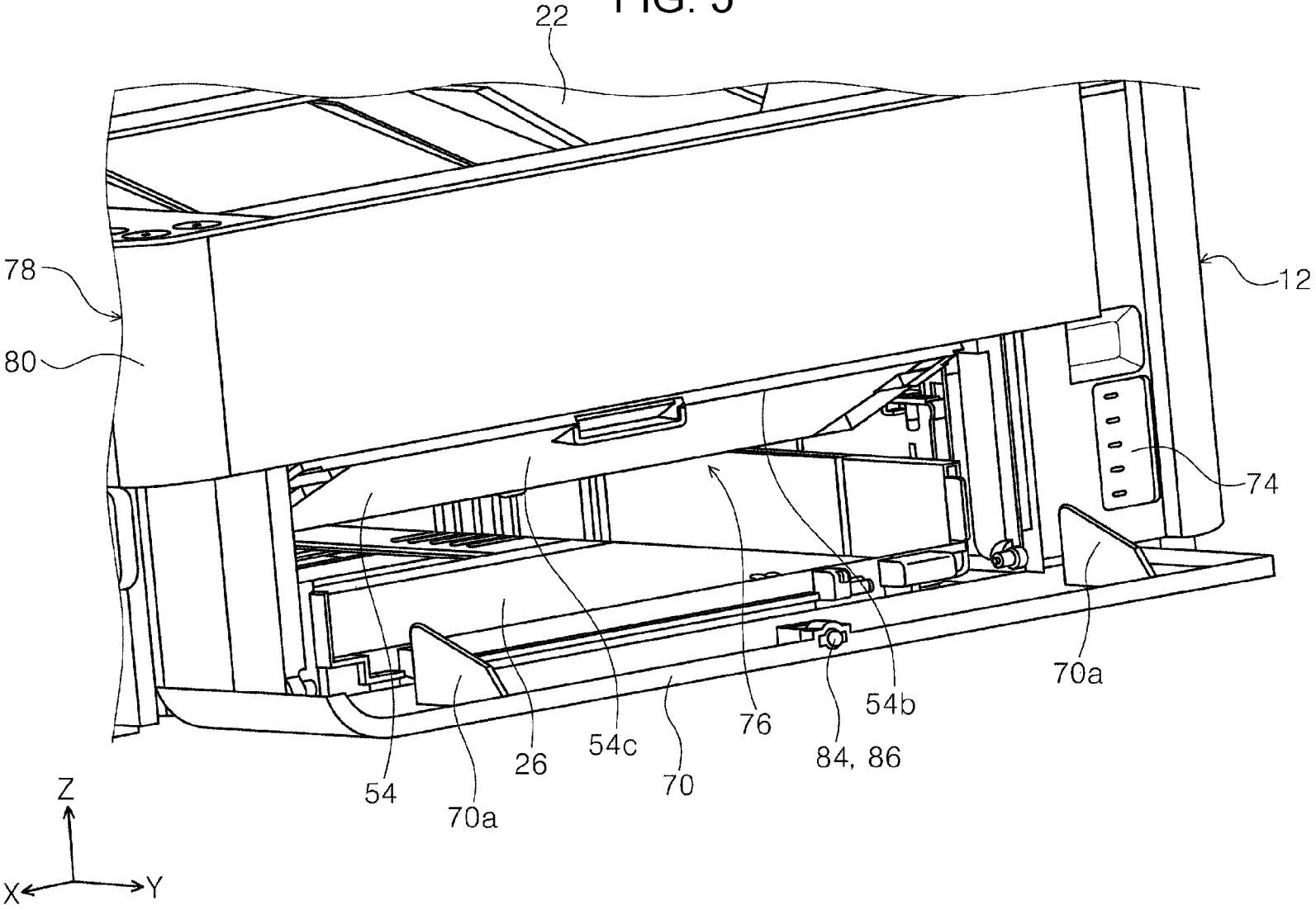
FIG. 5 is a perspective view illustrating the medium receiving tray which is in a medium unreceivable state in the printer according to the first embodiment.
Figure 6:
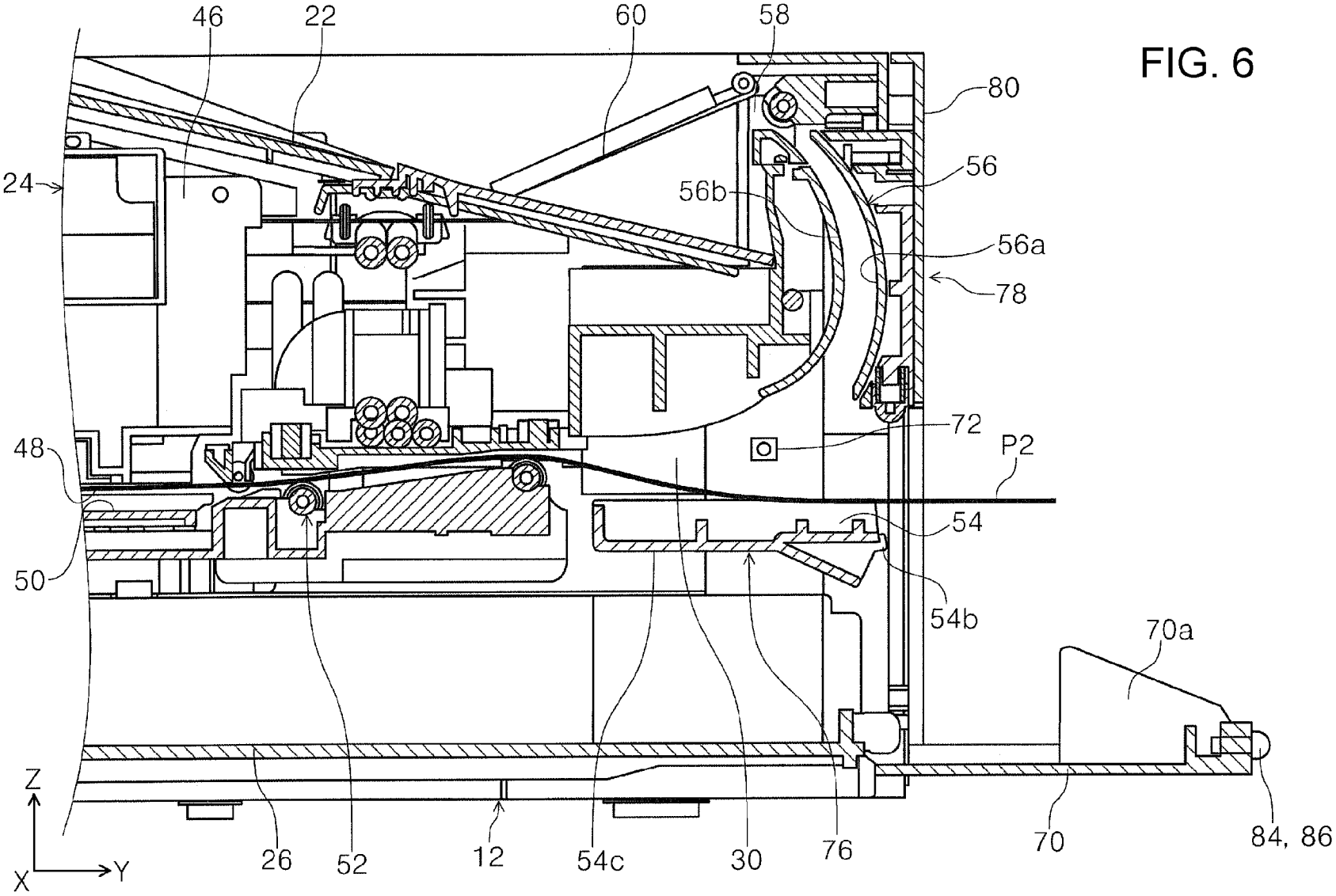
FIG. 6 is a sectional side view illustrating the medium receiving tray which is in the medium receiving state.
Figure 7:
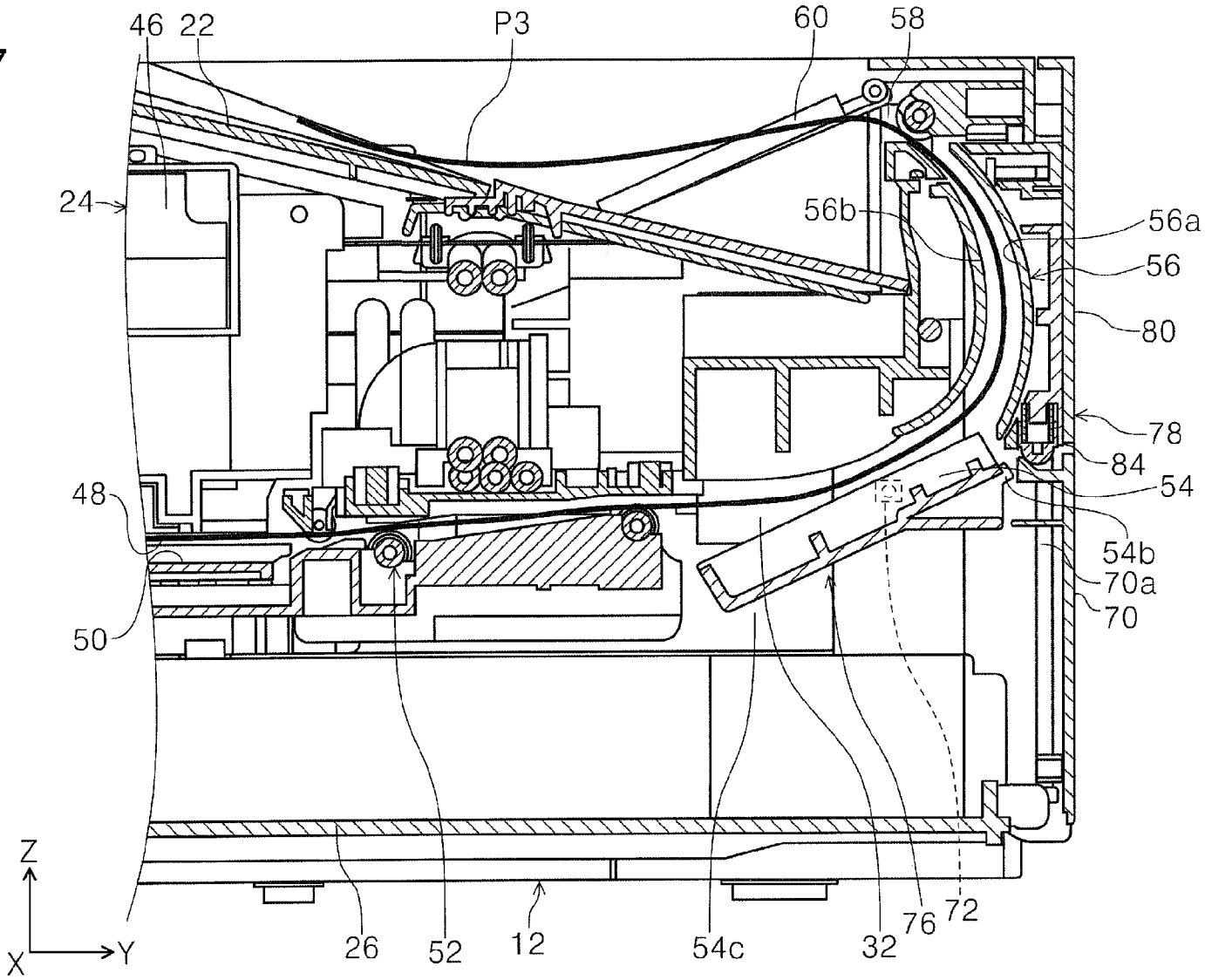
FIG. 7 is a sectional side view illustrating the medium receiving tray which is in the medium unreceivable state.
Figure 8:
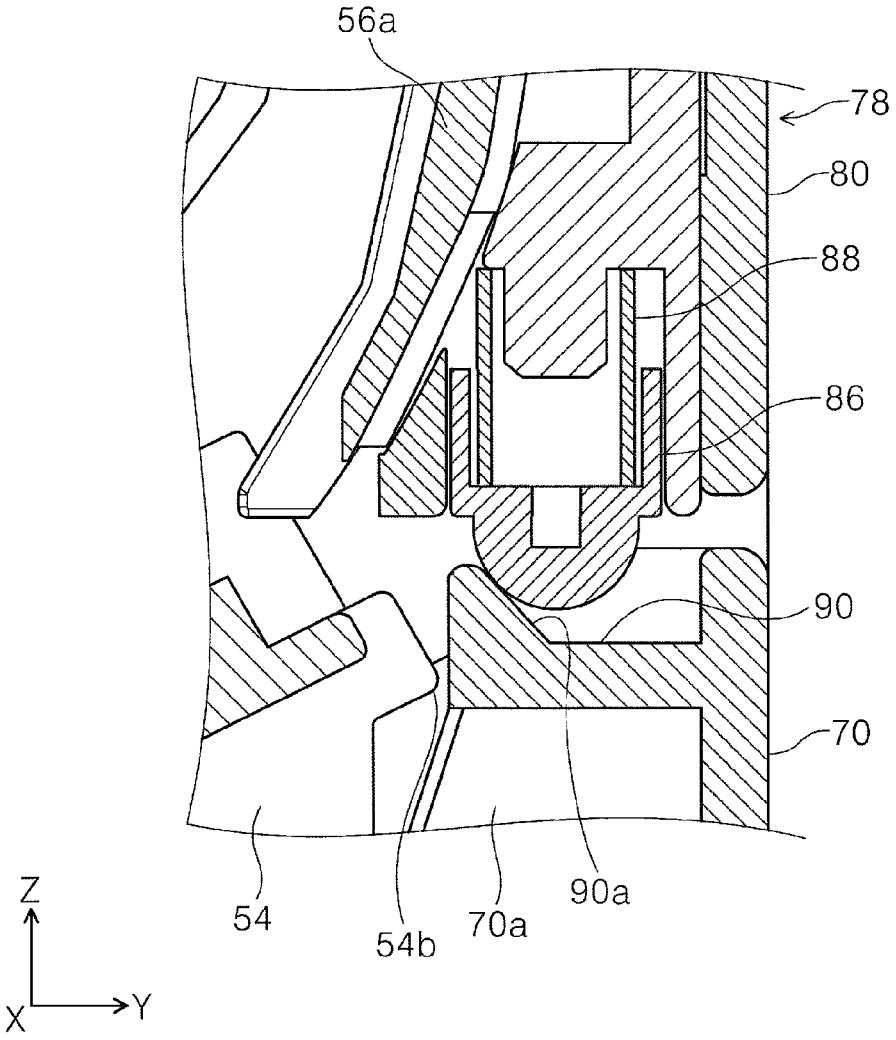
FIG. 8 is a sectional side view illustrating an engagement portion that causes a first cover and a second cover to be in an engaged state with each other.

FIG. 5 is a perspective view illustrating the medium receiving tray which is in a medium unreceivable state in the printer according to the first embodiment. FIG. 6 is a sectional side view illustrating the medium receiving tray which is in the medium receiving state. FIG. 7 is a sectional side view illustrating the medium receiving tray which is in the medium unreceivable state. FIG. 8 is a sectional side view illustrating an engagement portion that causes a first cover and a second cover to be in an engaged state with each other.

Figure 9A:
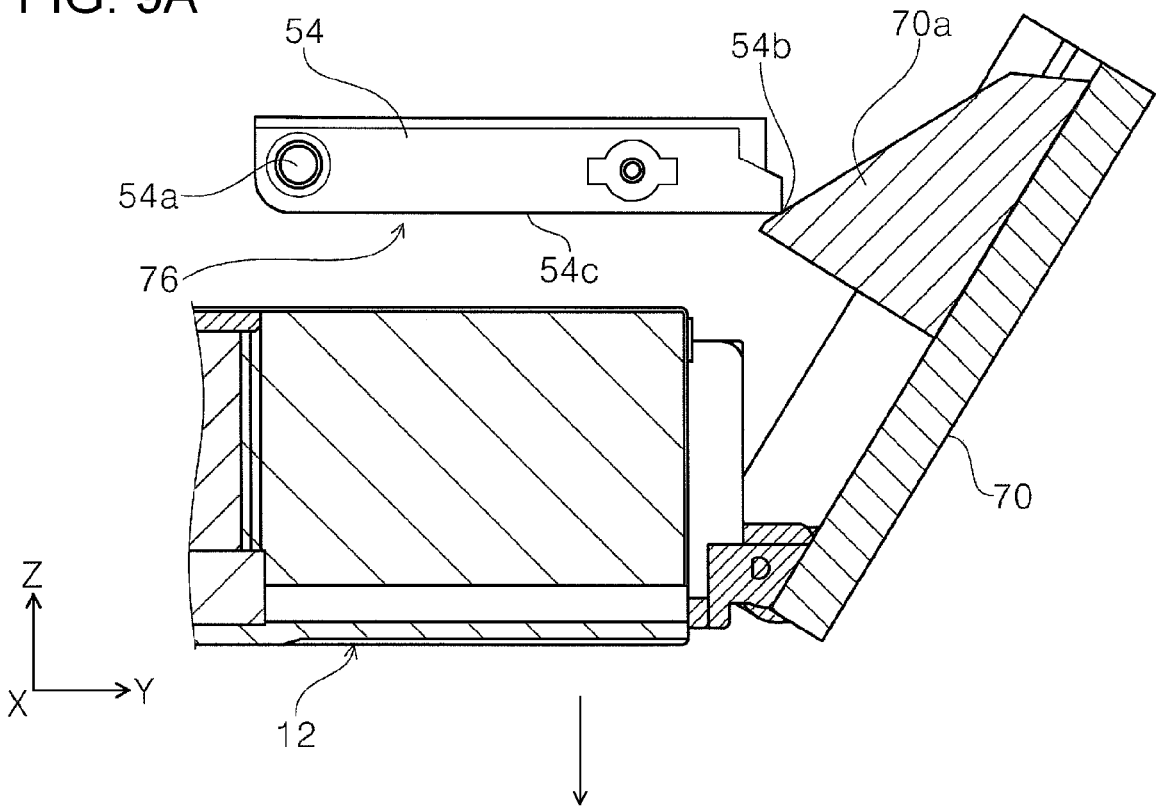
FIGS. 9A and 9B are side views illustrating a process of switching a state of the medium receiving tray from the medium receiving state to the medium unreceivable state when the first cover is closed.
Figure 9B:
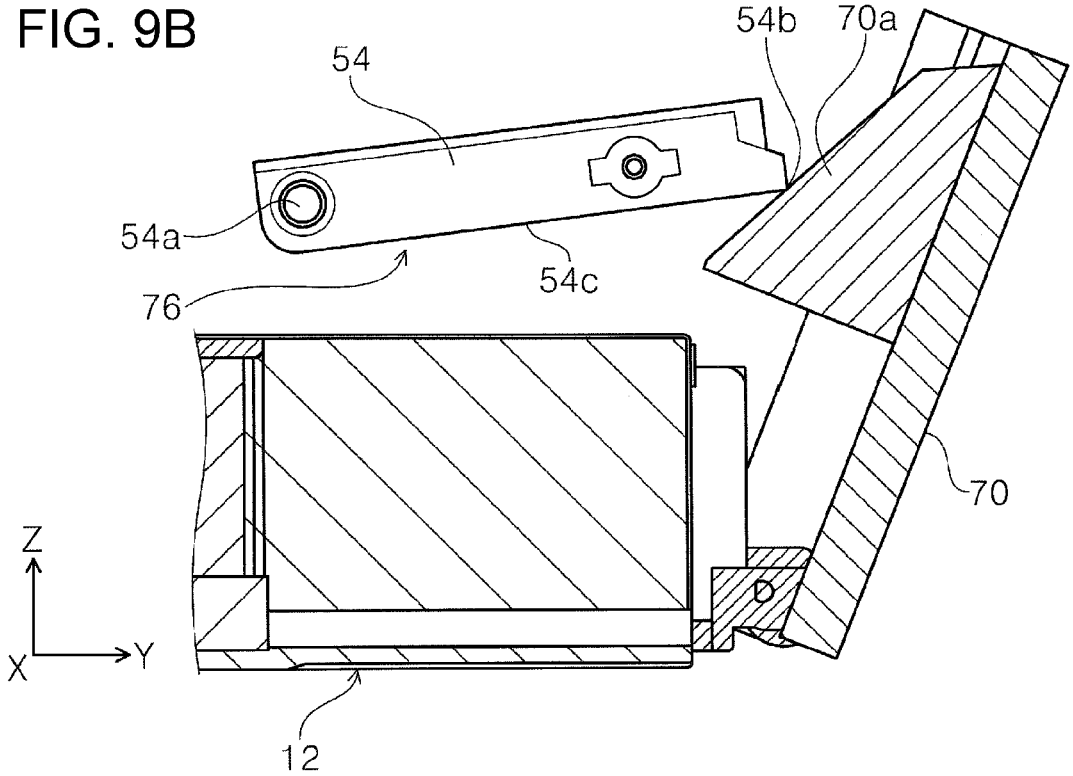
Figure 10A:
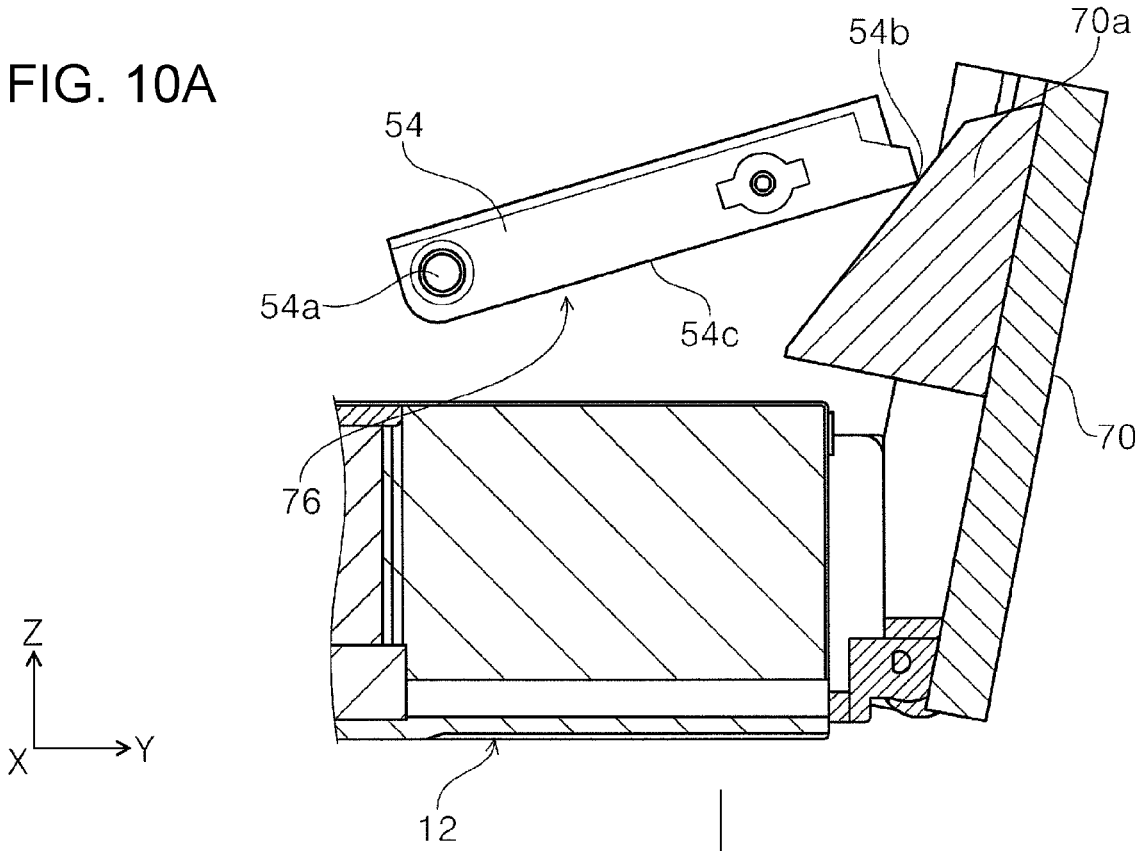
FIGS. 10A and 10B are side views illustrating the process of switching a state of the medium receiving tray from the medium receiving state to the medium unreceivable state when the first cover is closed.
Figure 10B:
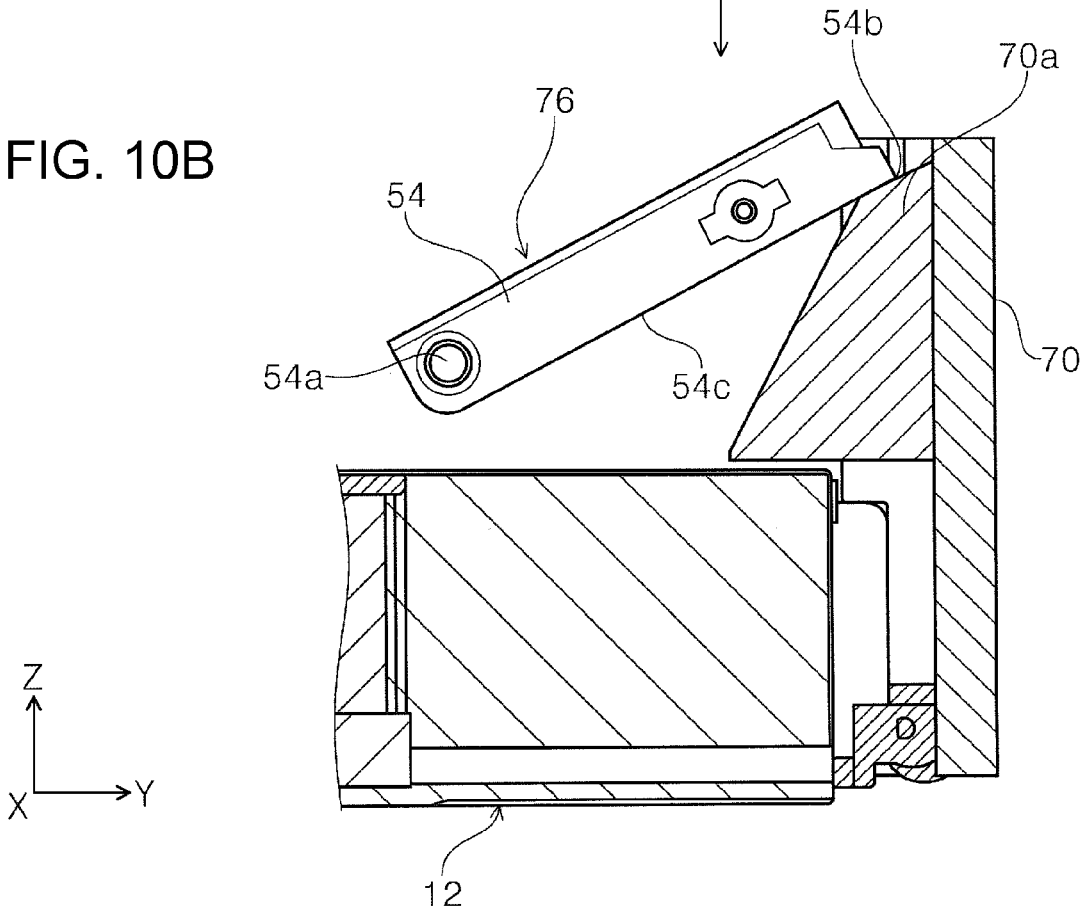
Figure 11:
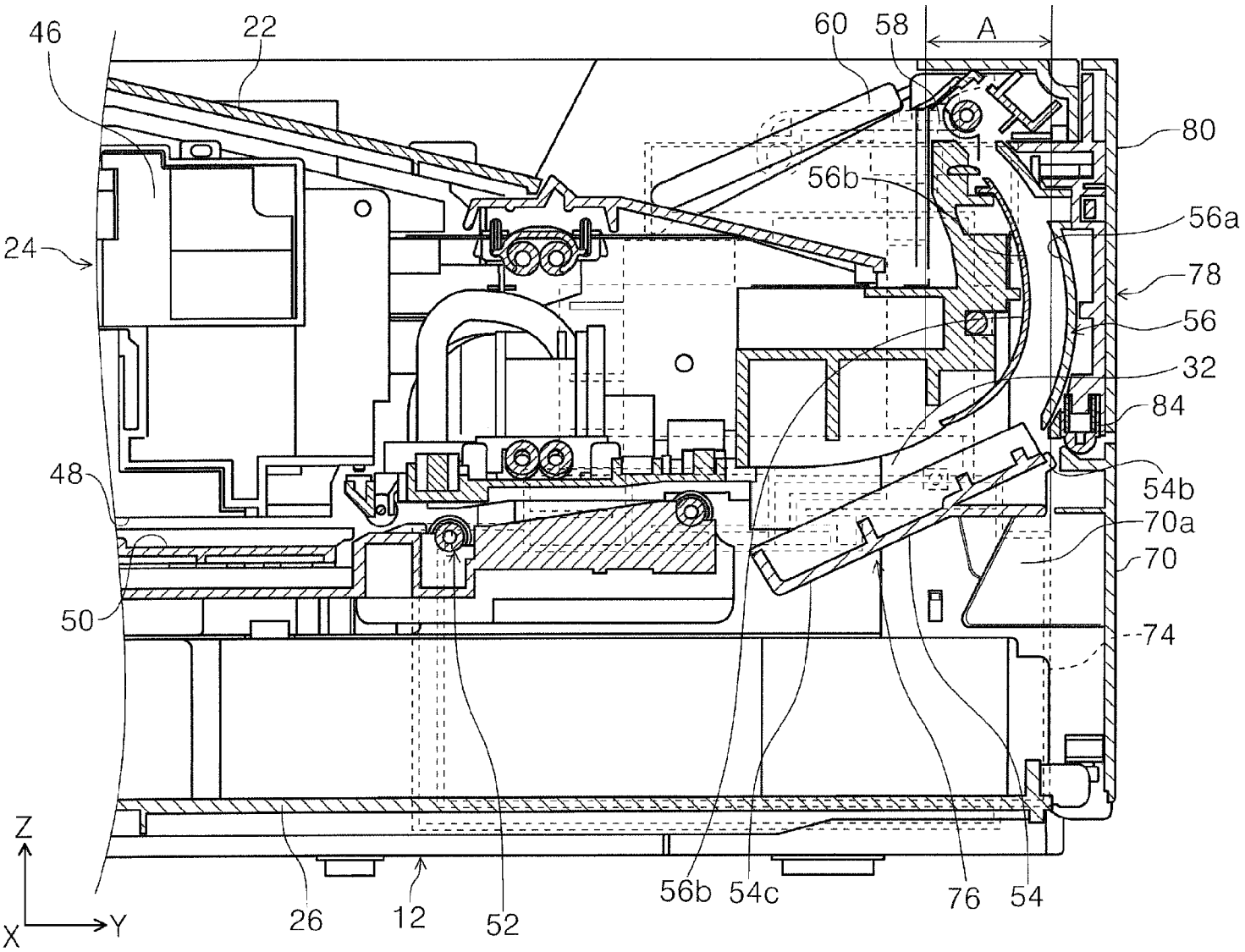
FIG. 11 is a sectional side view illustrating a relationship between an ink containing unit and a second transport route of the printer according to the first embodiment.

FIGS. 9A and 9B are side views illustrating a process of switching a state of the medium receiving tray from the medium receiving state to the medium unreceivable state when the first cover is closed. FIGS. 10A and 10B are side views illustrating the process of switching a state of the medium receiving tray from the medium receiving state to the medium unreceivable state when the first cover is closed. FIG. 11 is a sectional side view illustrating a relationship between a liquid containing unit and a second transport route of the printer according to the first embodiment.

Figure 12:
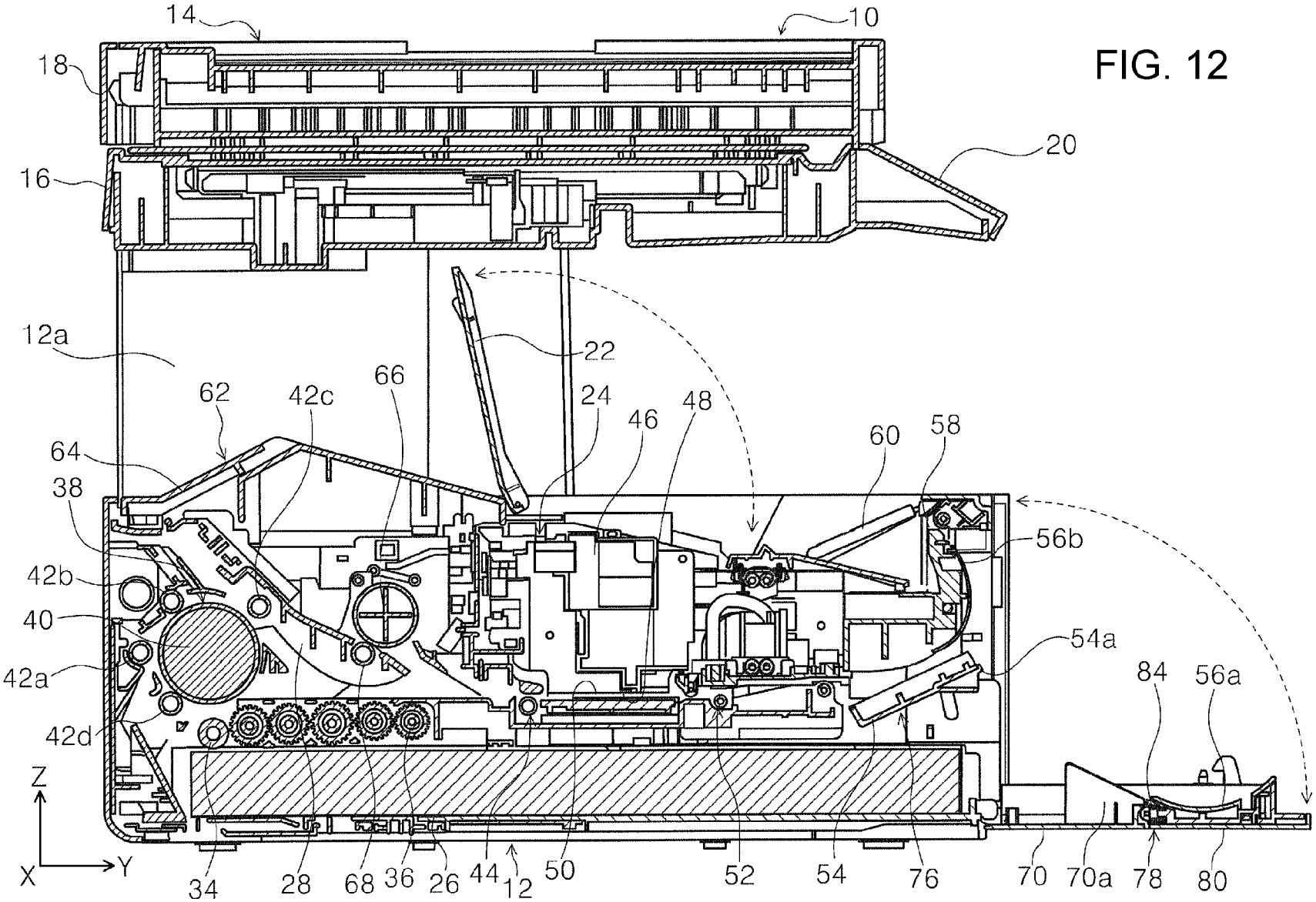
FIG. 12 is a sectional side view illustrating a state in which a cover and a support tray of the printer according to the first embodiment are opened.
Figure 13:
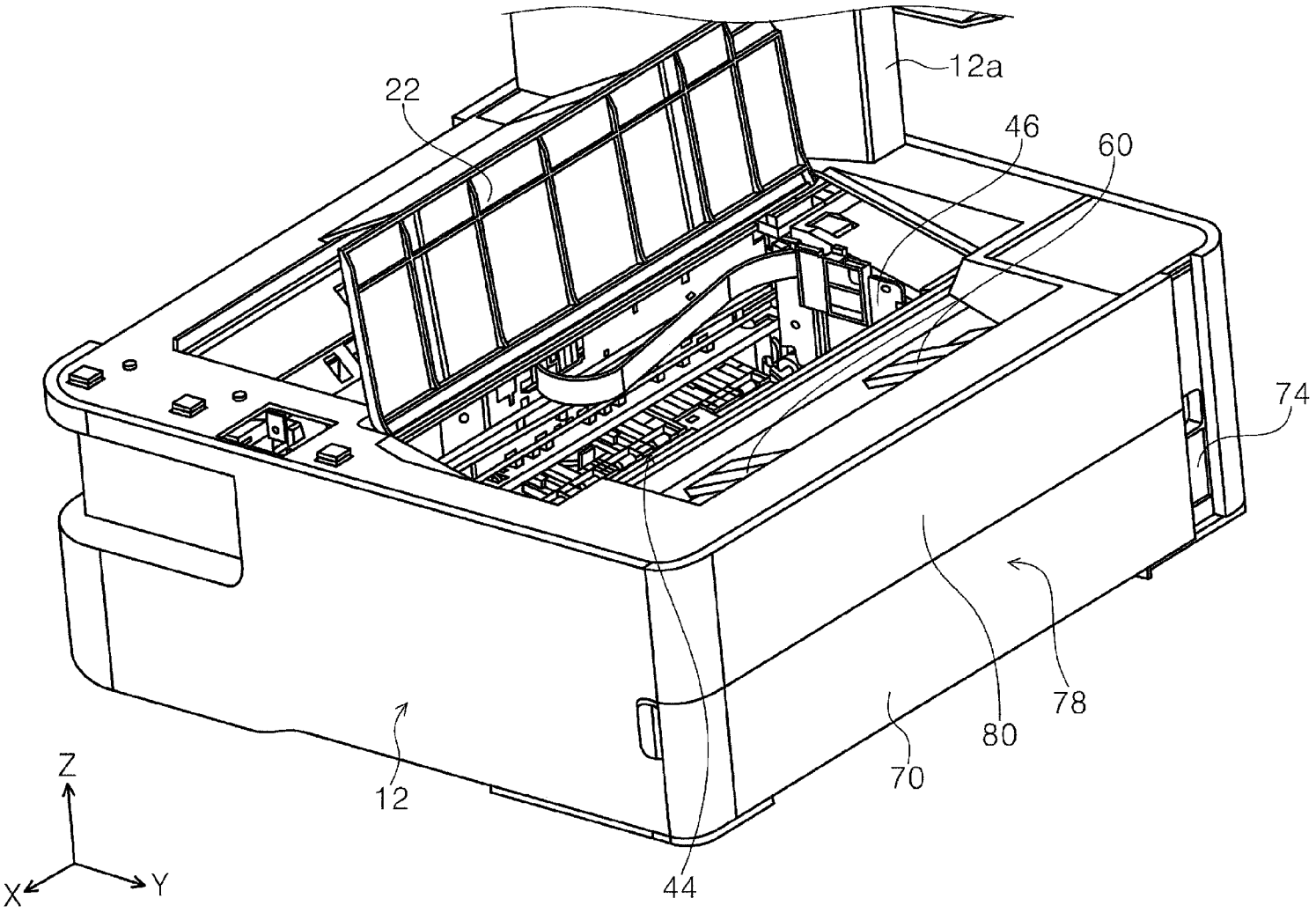
FIG. 13 is a perspective view illustrating a state in which the support tray of the printer according to the first embodiment is opened.
Figure 14:
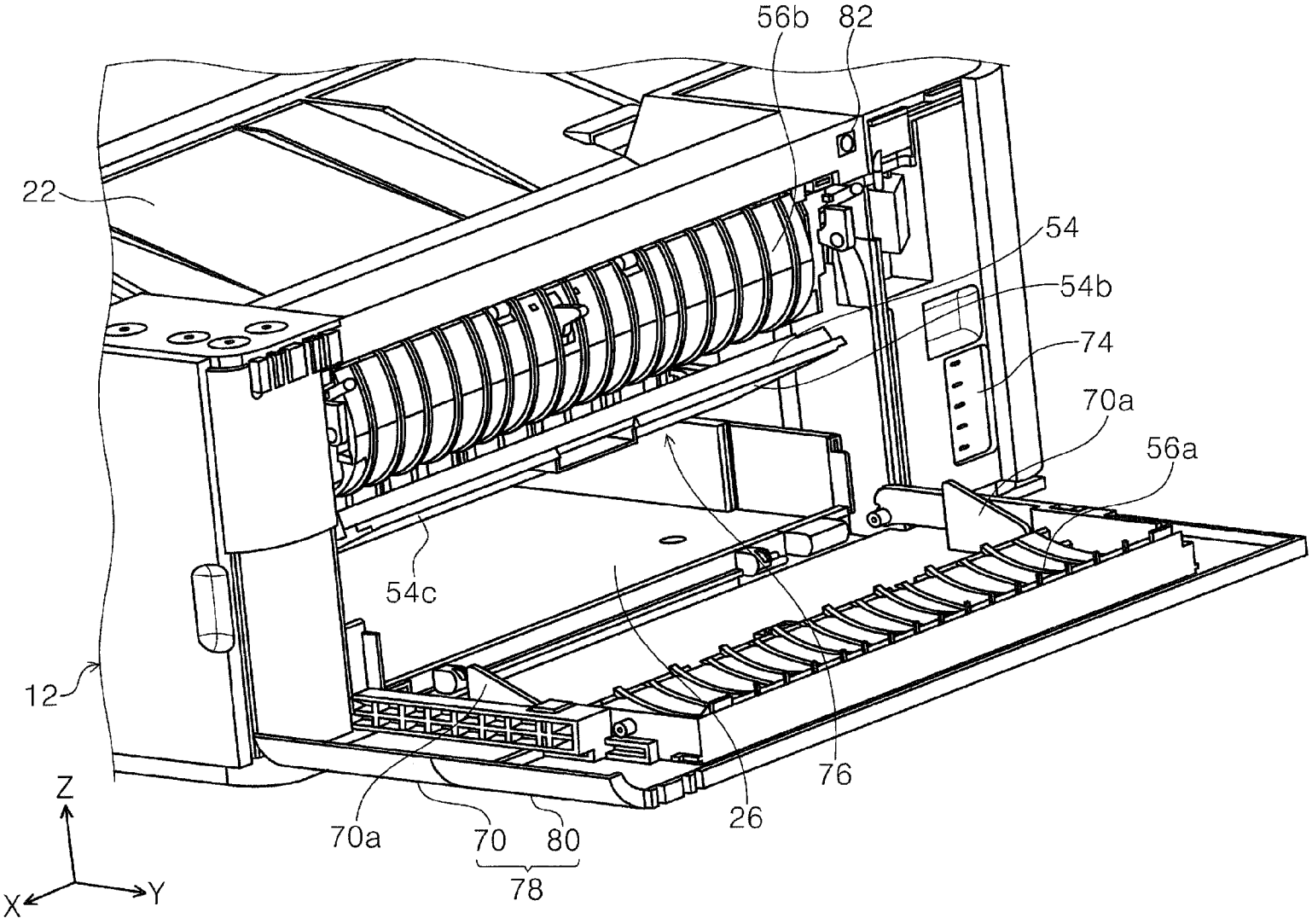
FIG. 14 is a perspective view illustrating a state in which the cover of the printer according to the first embodiment is opened.
Figure 15:
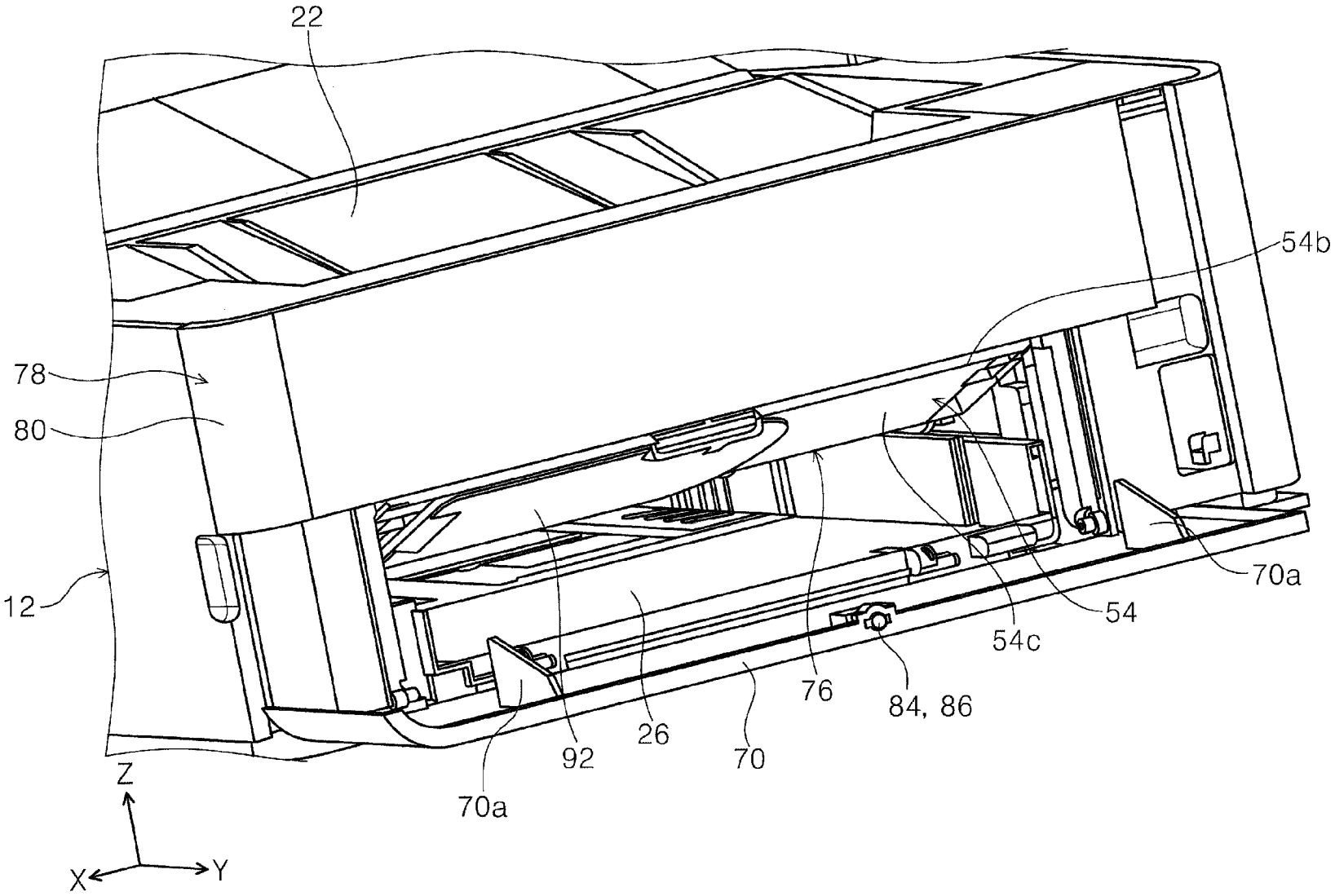
FIG. 15 is a perspective view illustrating the medium unreceivable state in a modification example of the medium receiving tray according to the first embodiment.

FIG. 12 is a sectional side view illustrating a state in which a cover and a support tray of the printer according to the first embodiment are opened. FIG. 13 is a perspective view illustrating a state in which the support tray of the printer according to the first embodiment is opened. FIG. 14 is a perspective view illustrating a state in which the cover of the printer according to the first embodiment is opened. FIG. 15 is a perspective view illustrating the medium unreceivable state in a modification example of the medium receiving tray according to the first embodiment.

Figure 16:
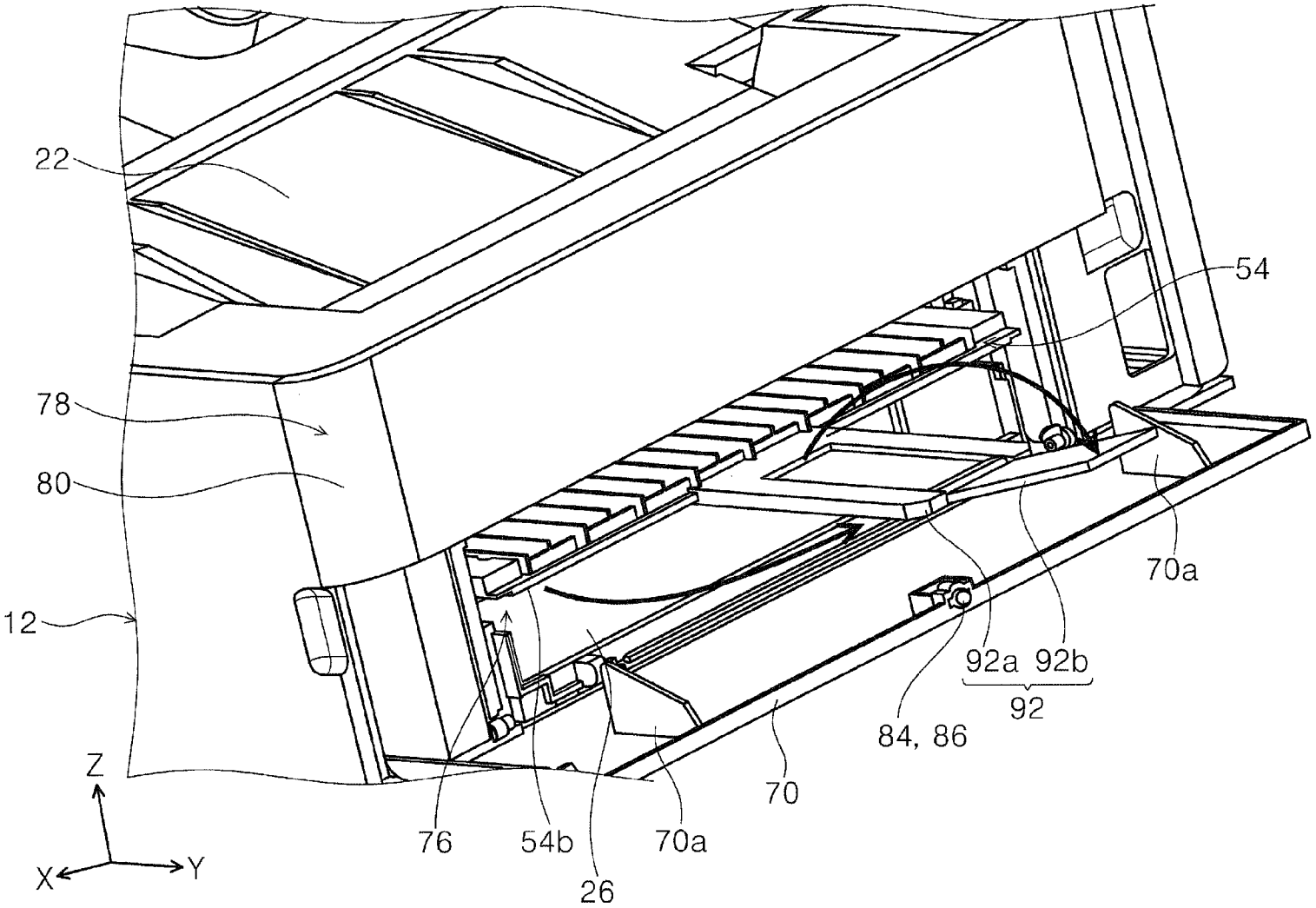
FIG. 16 is a perspective view illustrating a state in which an extension tray is unfolded in the medium receiving state in the modification example of the medium receiving tray according to the first embodiment.
Figure 17:
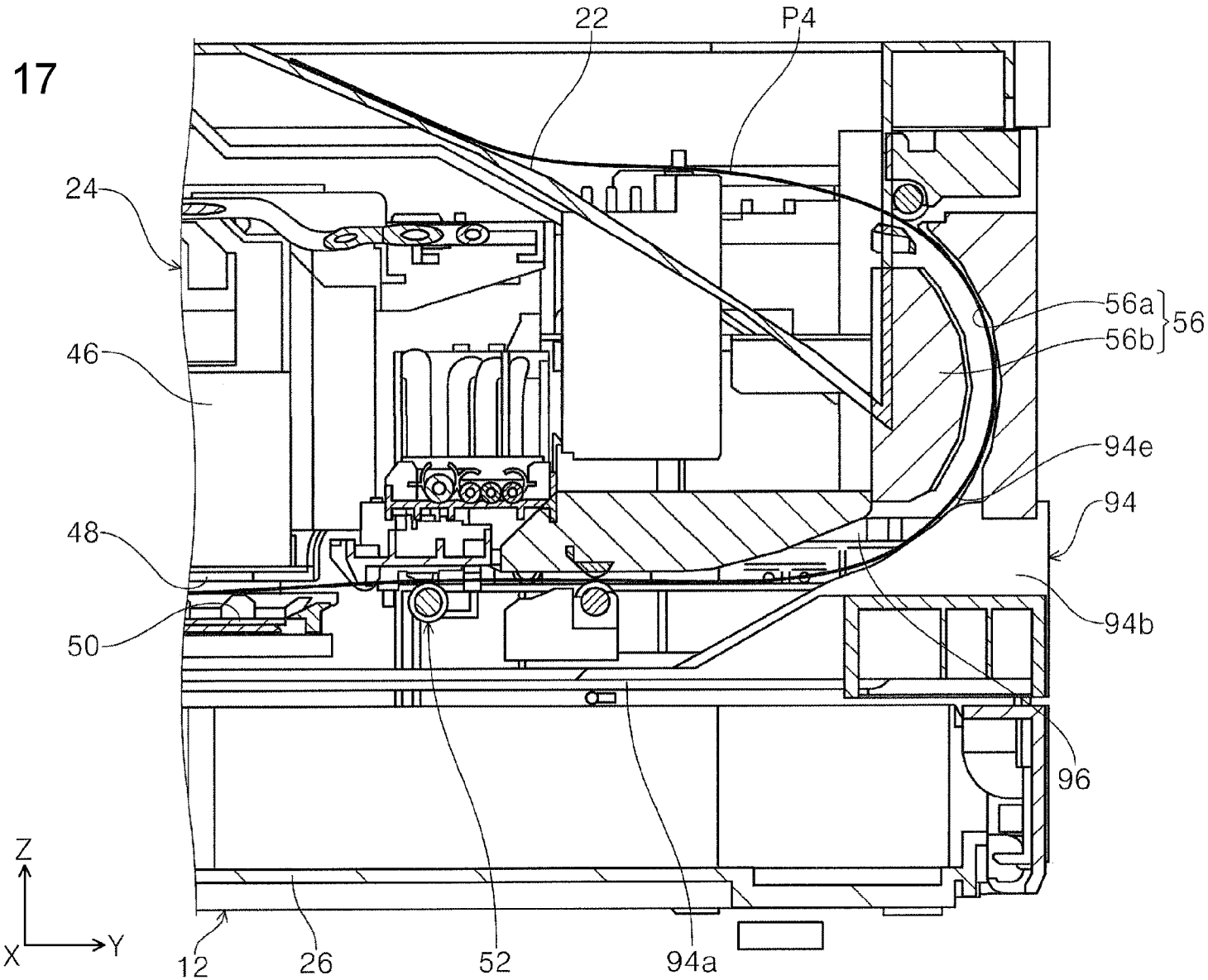
FIG. 17 is a sectional side view illustrating a medium unreceivable state of a medium receiving tray according to a second embodiment.
Figure 18:
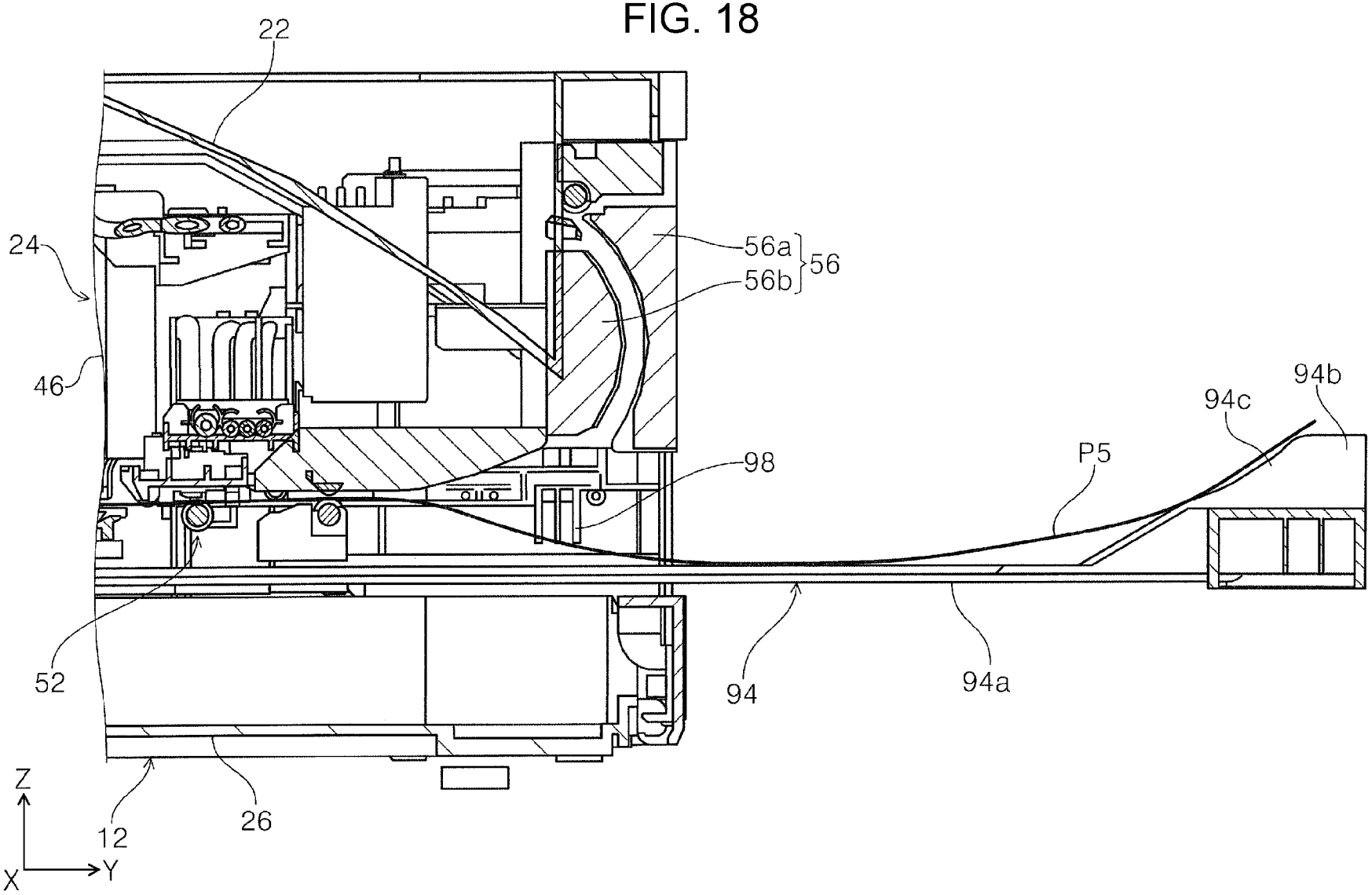
FIG. 18 is a sectional side view illustrating a medium receiving state of the medium receiving tray according to the second embodiment.
Figure 19:
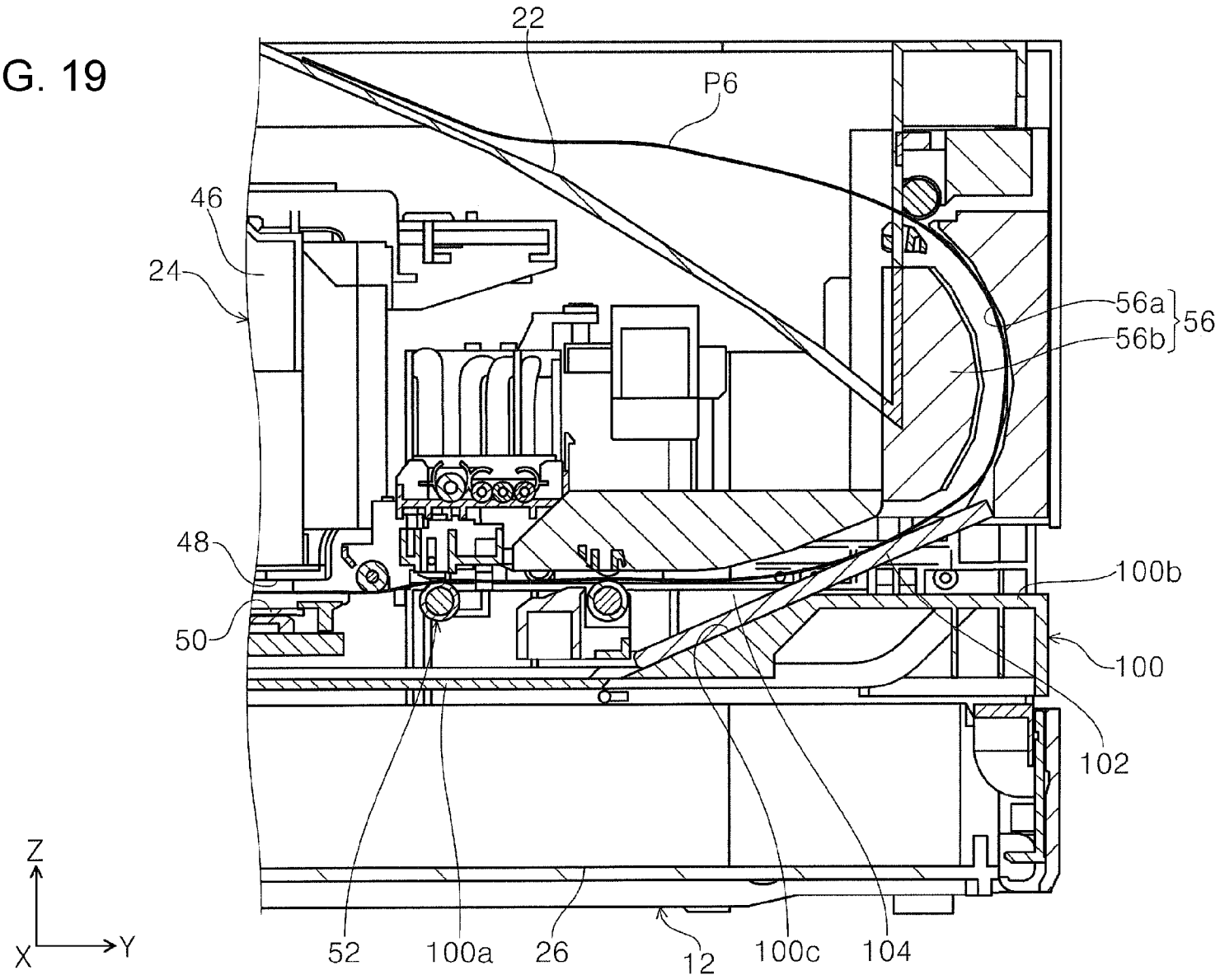
FIG. 19 is a sectional side view illustrating a medium unreceivable state of a medium receiving tray according to a third embodiment.

FIG. 16 is a perspective view illustrating a state in which an extension tray is unfolded in the medium receiving state in the modification example of the medium receiving tray according to the first embodiment. FIG. 17 is a sectional side view illustrating a medium unreceivable state of a medium receiving tray according to a second embodiment. FIG. 18 is a sectional side view illustrating a medium receiving state of the medium receiving tray according to the second embodiment. FIG. 19 is a sectional side view illustrating a medium unreceivable state of a medium receiving tray according to a third embodiment.

Figure 20:
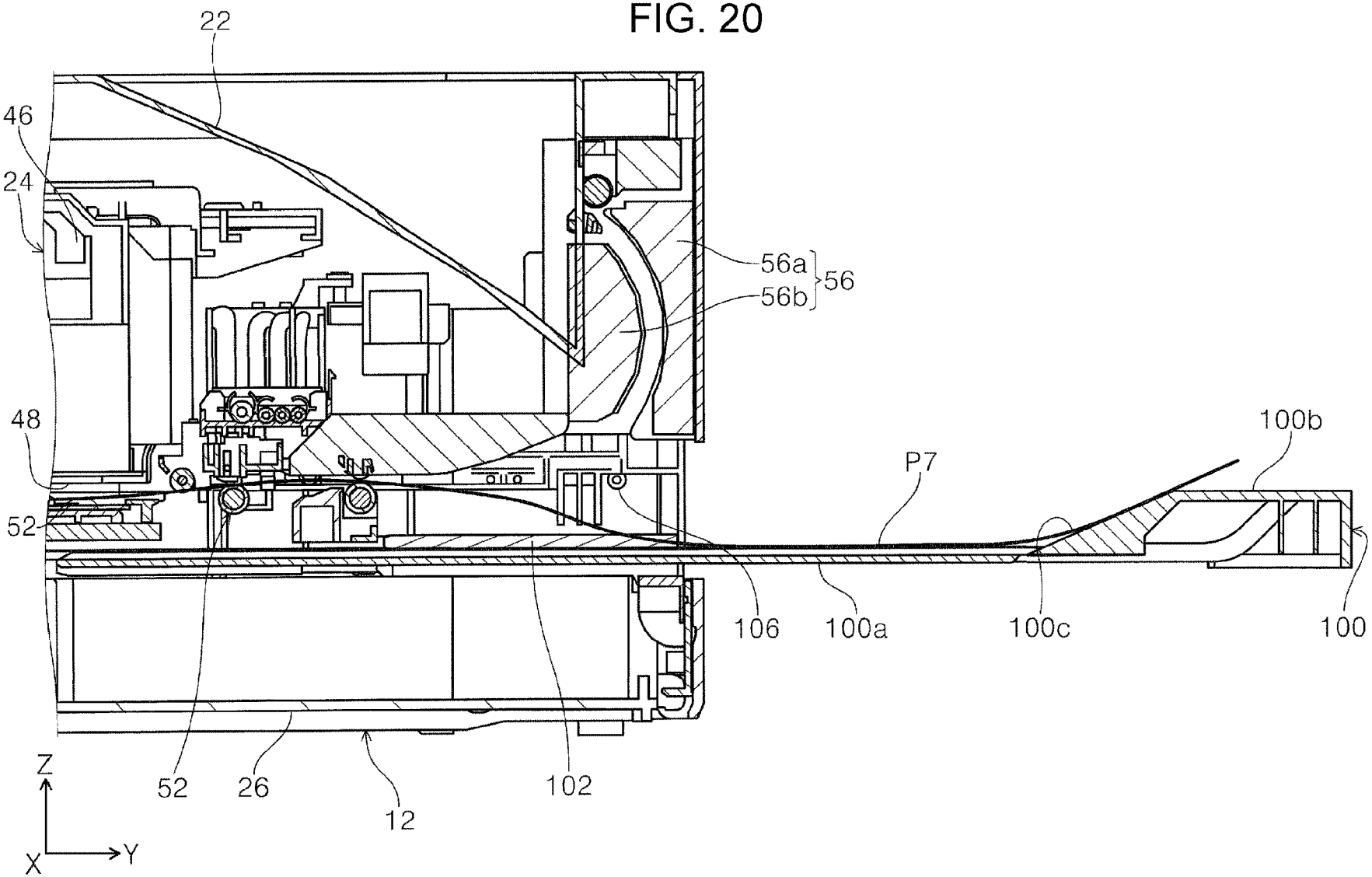
FIG. 20 is a sectional side view illustrating a medium receiving state of the medium receiving tray according to the third embodiment.
Figure 21:
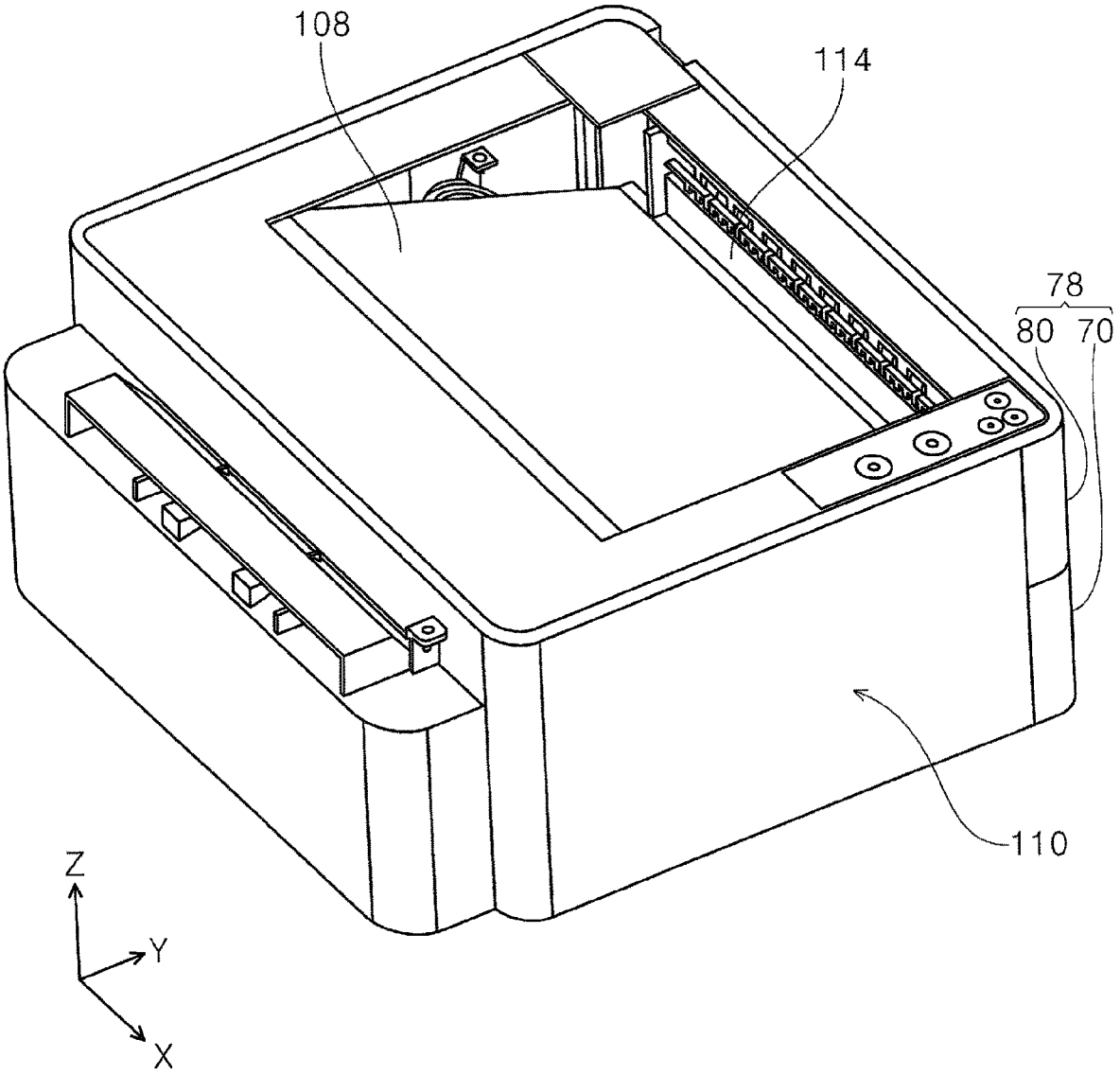
FIG. 21 is a perspective view illustrating a state in which a support tray according to a fourth embodiment is installed in a housing.
Figure 22:
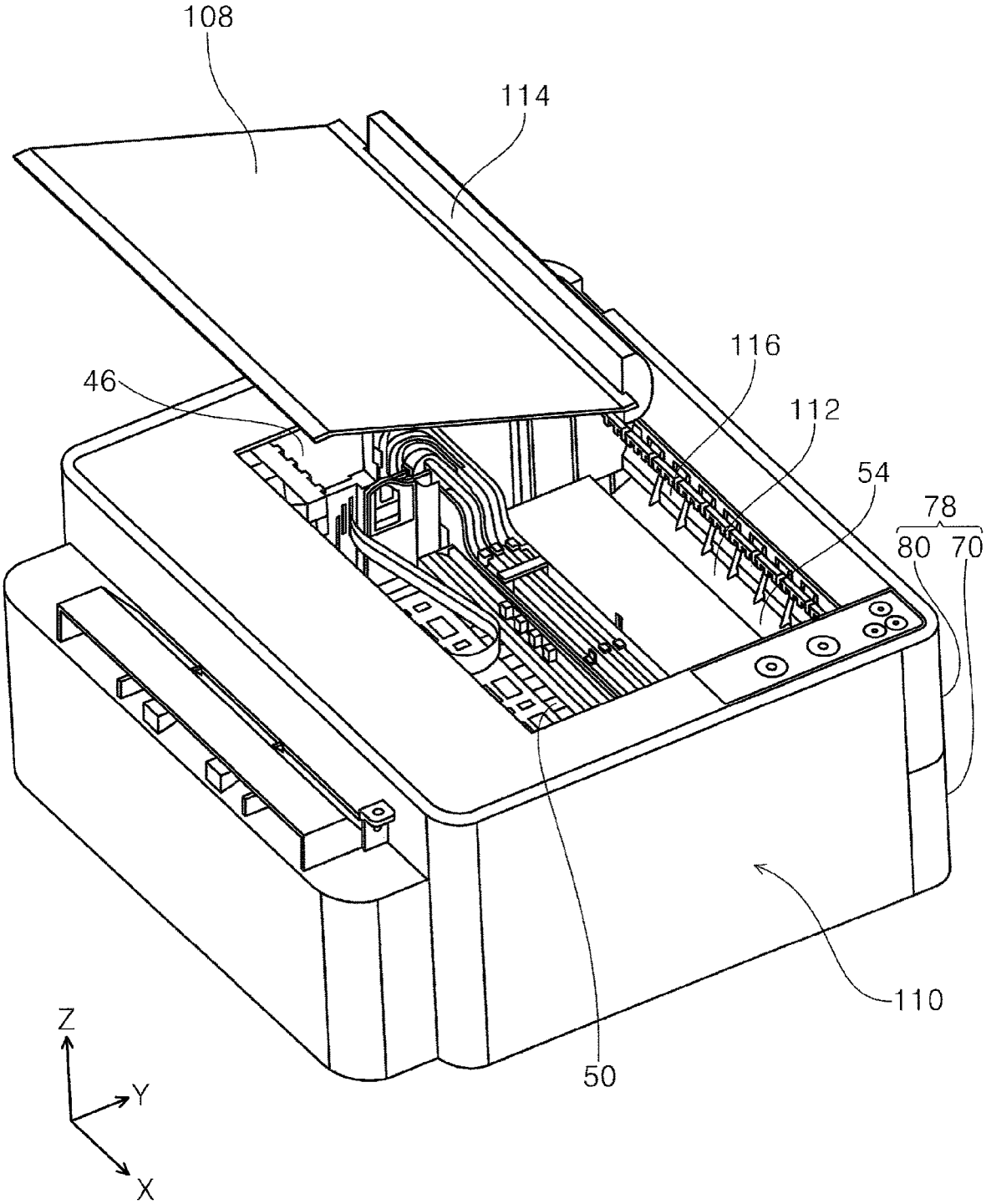
FIG. 22 is a perspective view illustrating a state in which the support tray according to the fourth embodiment is detached from the housing.
Figure 23:
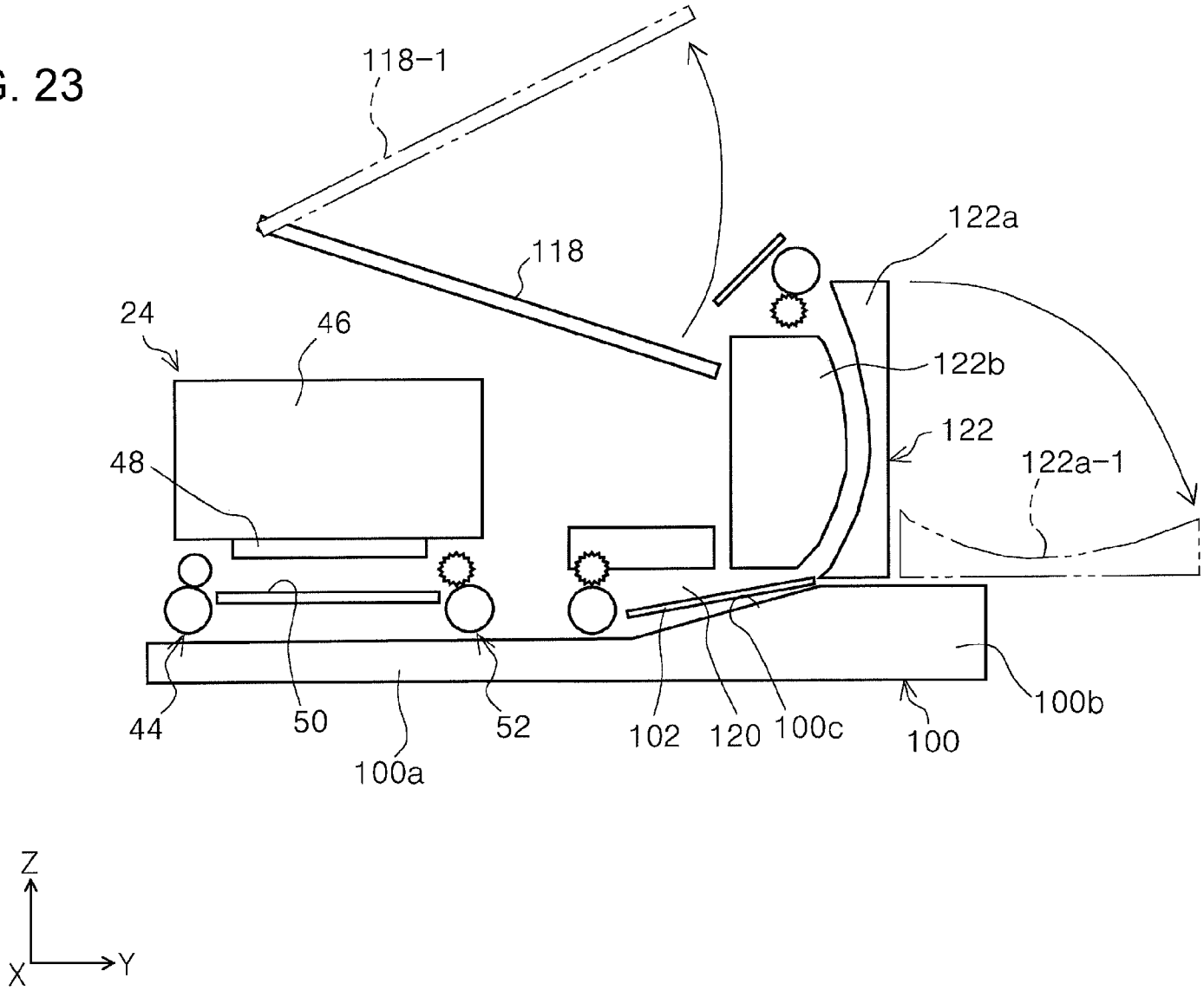
FIG. 23 is a schematic view illustrating an unjamming state in a printer according to a fifth embodiment is opened.

FIG. 20 is a sectional side view illustrating a medium receiving state of the medium receiving tray according to the third embodiment. FIG. 21 is a perspective view illustrating a state in which a support tray according to a fourth embodiment is installed in a housing. FIG. 22 is a perspective view illustrating a state in which the support tray according to the fourth embodiment is detached from the housing. FIG. 23 is a schematic view illustrating an unjamming state in a printer according to a fifth embodiment is opened.

Figure 24:
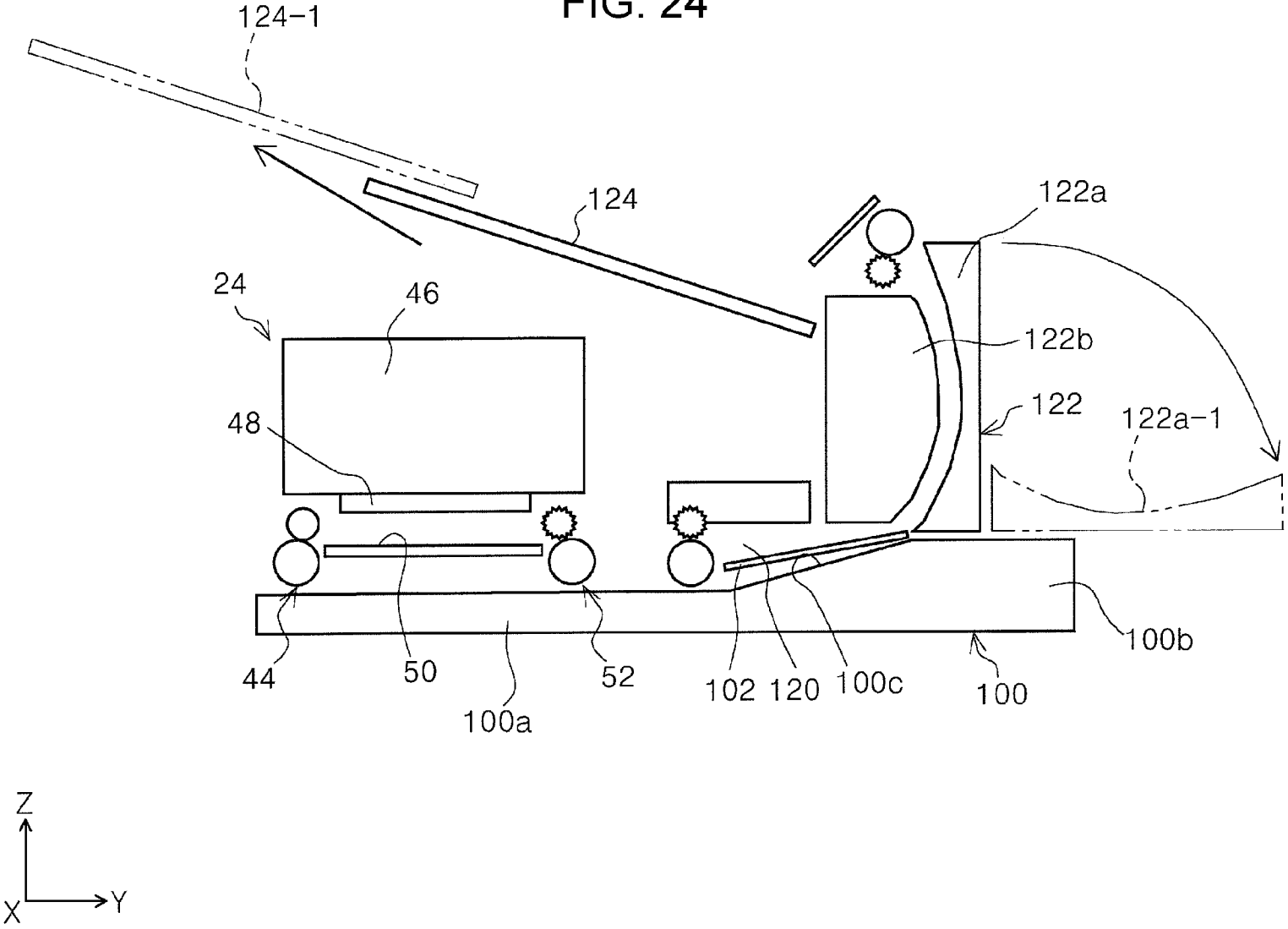
FIG. 24 is a schematic view illustrating an unjamming state in a printer according to a sixth embodiment is opened.
Figure 25:
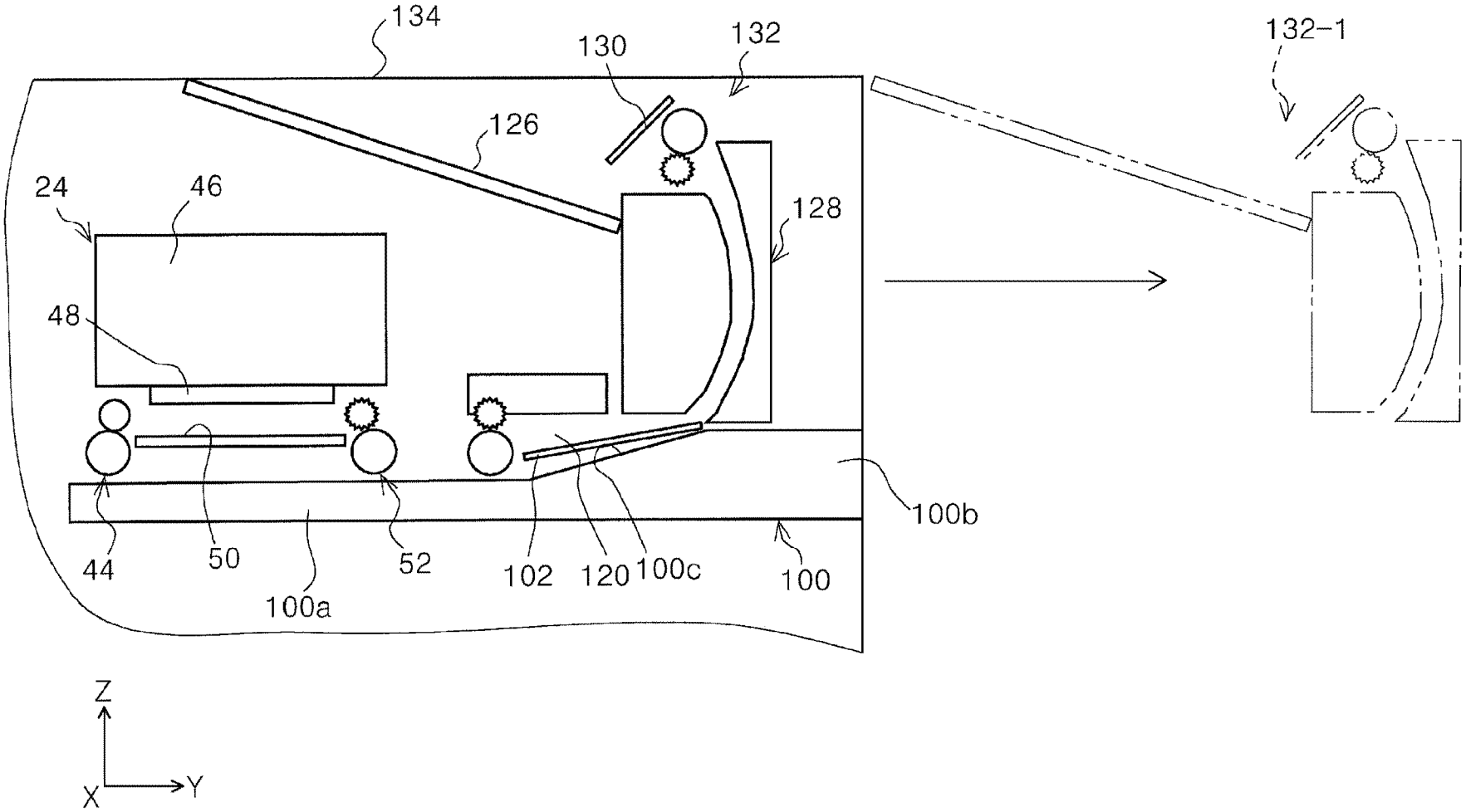
FIG. 25 is a schematic view illustrating an unjamming state in a printer according to a seventh embodiment is opened.
Figure 26:
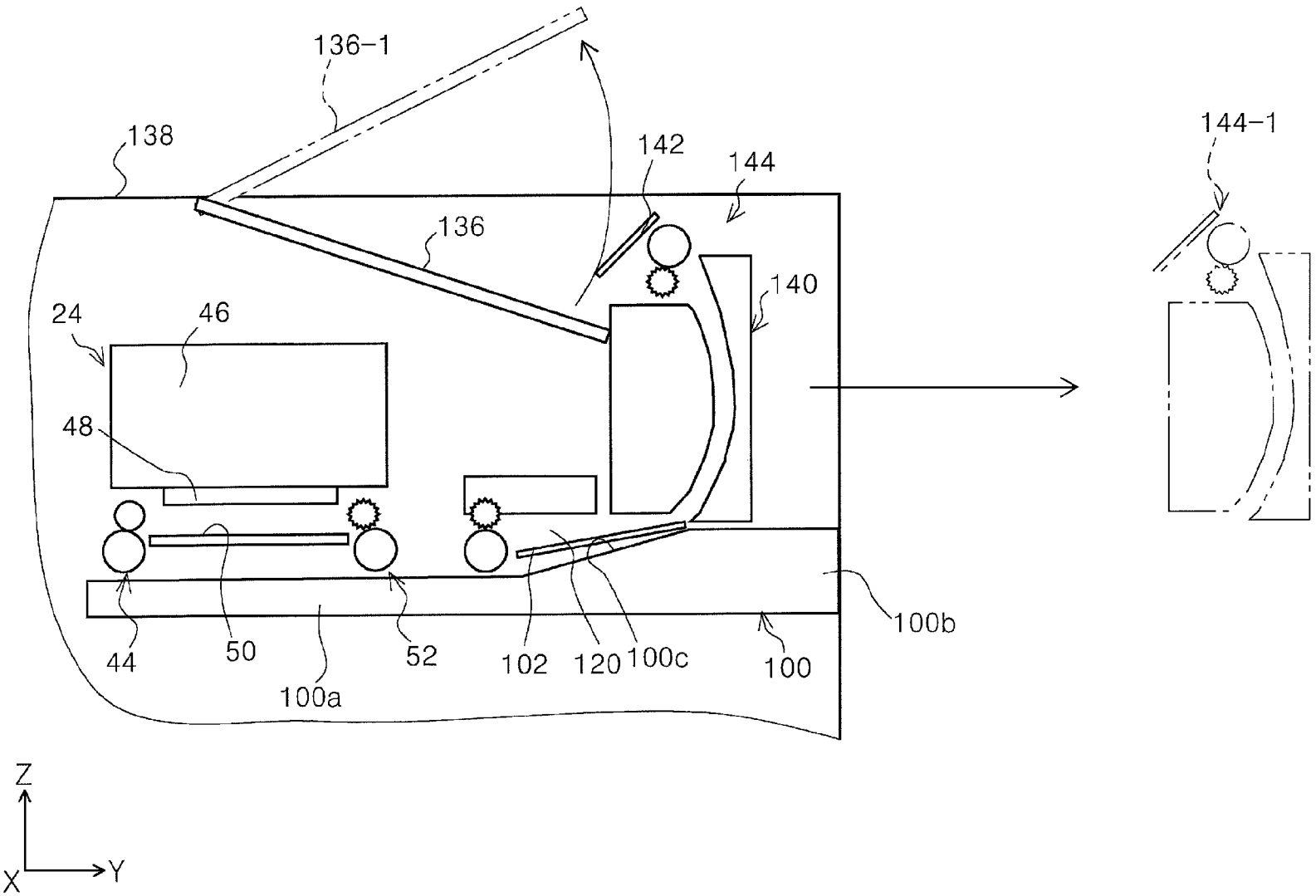
FIG. 26 is a schematic view illustrating an unjamming state in a printer according to an eighth embodiment is opened.
Figure 27:
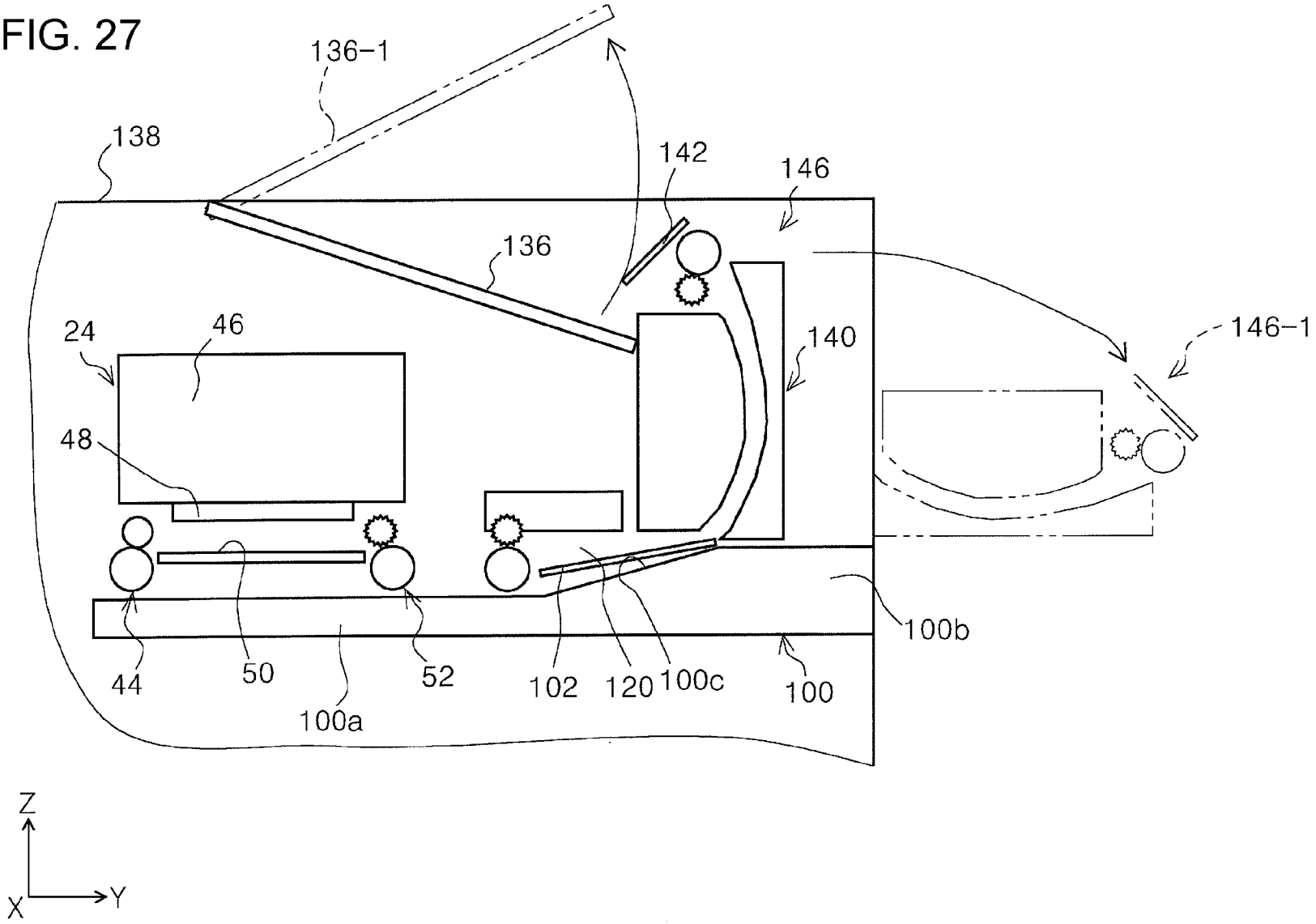
FIG. 27 is a schematic view illustrating an unjamming state in a printer according to a ninth embodiment is opened.

FIG. 24 is a schematic view illustrating an unjamming state in a printer according to a sixth embodiment is opened. FIG. 25 is a schematic view illustrating an unjamming state in a printer according to a seventh embodiment is opened. FIG. 26 is a schematic view illustrating an unjamming state in a printer according to an eighth embodiment is opened. FIG. 27 is a schematic view illustrating an unjamming state in a printer according to a ninth embodiment is opened.

Figure 28:
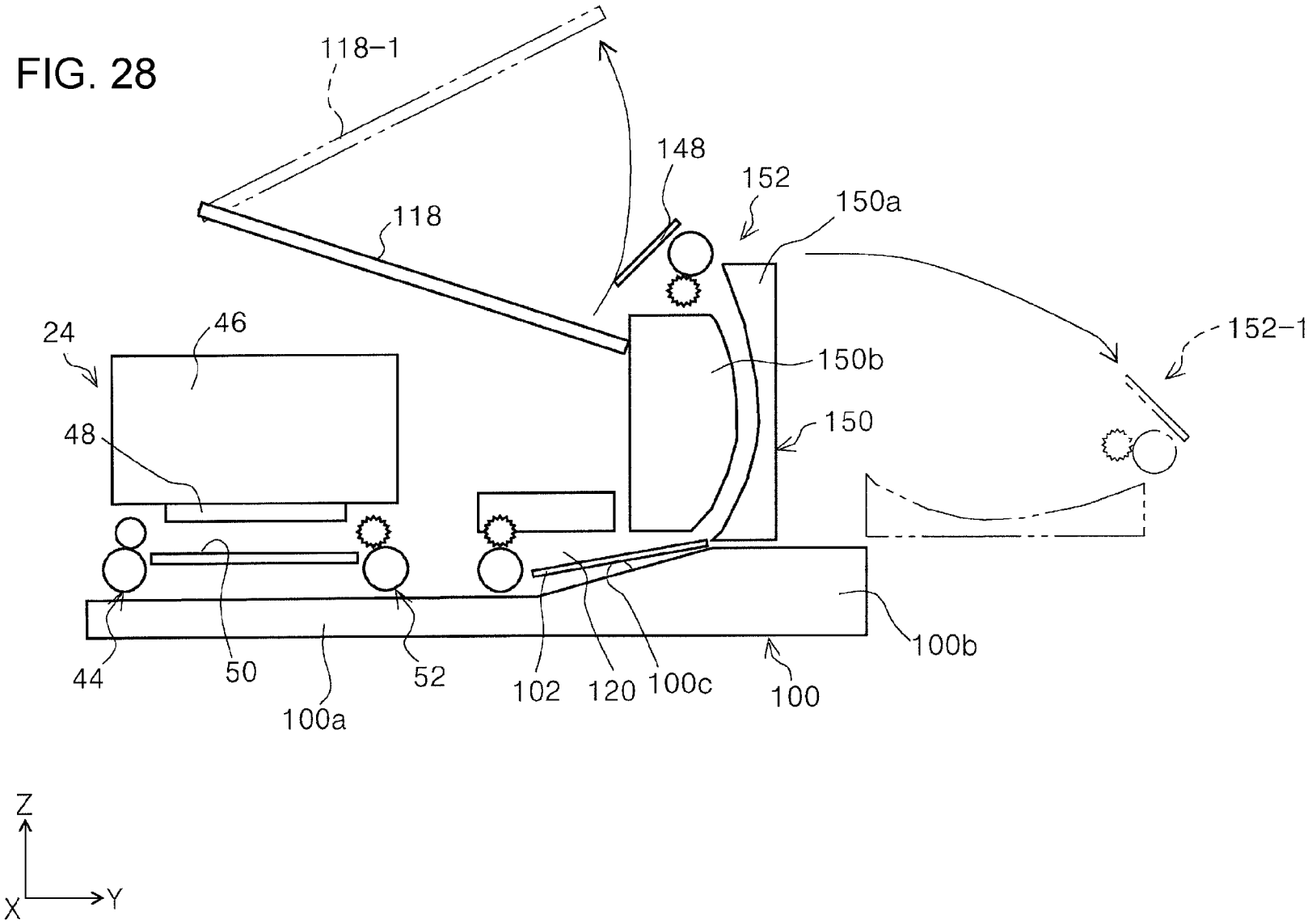
FIG. 28 is a schematic view illustrating an unjamming state in a printer according to a tenth embodiment is opened.
Figure 29:
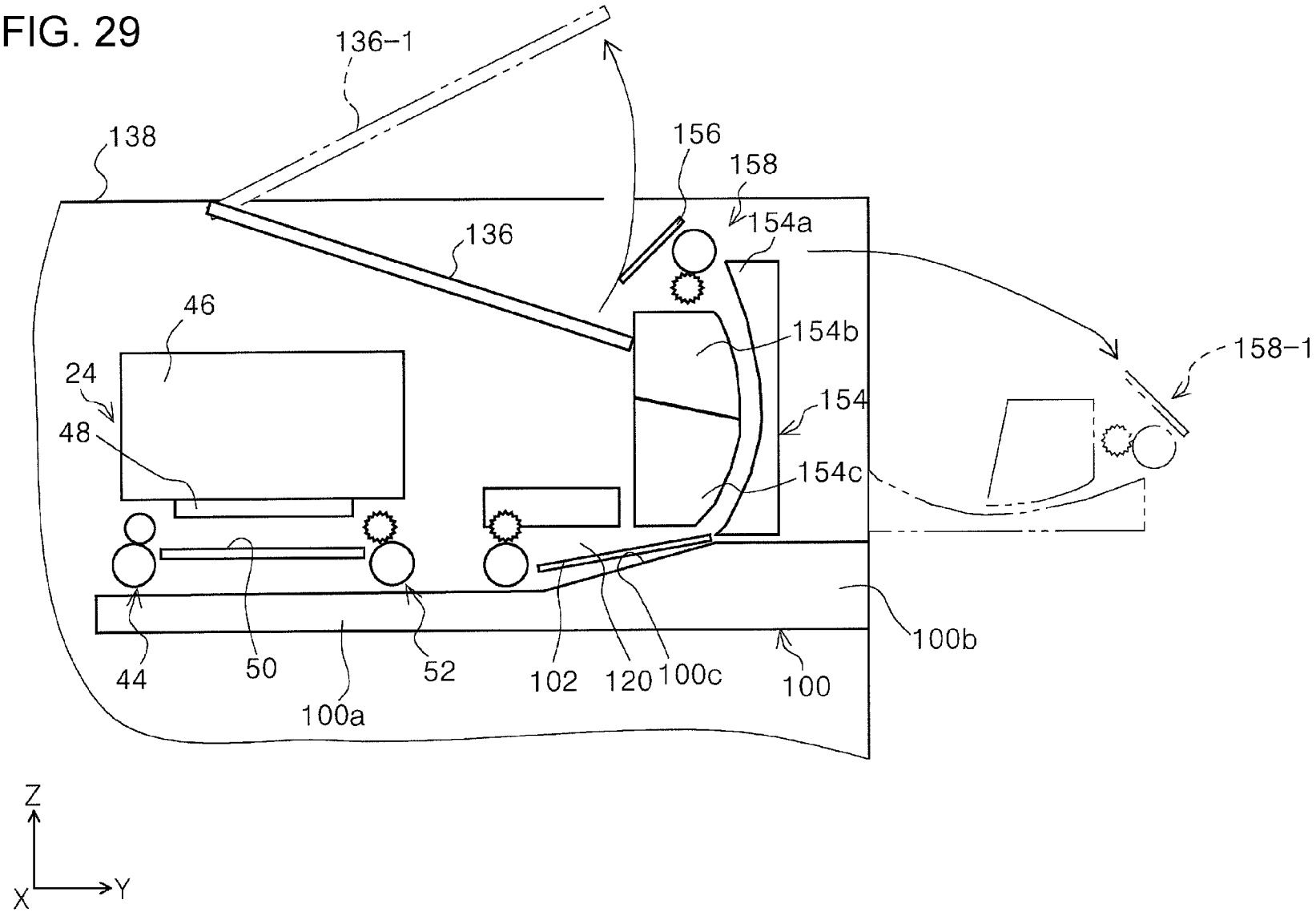
FIG. 29 is a schematic view illustrating an unjamming state in a printer according to an eleventh embodiment is opened.

FIG. 28 is a schematic view illustrating an unjamming state in a printer according to a tenth embodiment is opened. FIG. 29 is a schematic view illustrating an unjamming state in a printer according to an eleventh embodiment is opened.

In addition, in an X-Y-Z coordinate system in the drawings, an X direction represents a width direction of a recording medium, that is, an apparatus width direction, a Y direction represents a transport direction of the recording medium in a transport route in a recording apparatus, that is an apparatus depth direction, and a Z direction represents an apparatus height direction.

First Embodiment

Overview of Printer

An overall configuration of a printer 10 is described with reference to FIG. 1. The printer 10 is configured as an ink jet printer as an example of the recording apparatus. The printer 10 is configured as a multifunction printer including a housing 12 and a scanner 14. Supports 12*a* projecting in a +Z direction are formed at both end portions of the housing 12 in an X-axis direction. The scanner 14 is disposed above the housing 12 and is supported by the supports 12*a*.

The scanner 14 includes a scanner main body 16 and an ADF unit 18. An operating unit 20 is provided at an end portion of the scanner main body 16 on a side of a +Y direction. The operating unit 20 has a plurality of operating buttons and a display panel. The operating unit 20 in the embodiment has a configuration in which it is possible to operate a recording operation in the printer 10 and an image reading operation in the scanner 14.

A support tray 22 is attached to an upper portion of the housing 12 so as to be rotatable with respect to the housing 12. In the embodiment, the support tray 22 is configured to receive a medium that is discharged and reaches the tray from an inside of the housing 12, in a tilted posture.

Regarding Medium Transport Route

FIG. 2 illustrates a medium transport route 28 from a medium accommodating unit 26 to the support tray 22. In the embodiment, the medium transport route 28 includes a first transport route 30 and a second transport route 32 on a downstream side in the transport direction from a recording unit 24 as a "processing unit". The first transport route 30 is described below in FIGS. 4 and 6, and transport of a medium by using the second transport route 32 is described in FIGS. 2 and 3.

The medium accommodating unit 26 is provided at an end portion of the housing 12 on a side of a −Z direction in FIG. 2. A pick-up roller 34 is provided on a side of a +Z direction of the medium accommodating unit 26. The pick-up roller 34 is configured to be rotatable around a rotary shaft 36 as a point. The pick-up roller 34 comes into contact with a medium P accommodated in the medium accommodating unit 26, thereby transporting the uppermost medium P of media accommodated in the medium accommodating unit 26 along the medium transport route 28 to the downstream side in the transport direction. A bold line to which a reference sign P is assigned in FIG. 2 represents a route of the medium P that is transported along the medium transport route 28.

A medium inverting unit 38 is provided on a downstream side of the pick-up roller 34 on the medium transport route 28. The medium inverting unit 38 includes an inverting roller 40 and driven rollers 42*a*, 42*b*, 42*c*, and 42*d* which are disposed around the inverting roller 40 and are rotatably driven along with the inverting roller 40.

The medium P fed by the pick-up roller 34 is fed via the medium inverting unit 38 to a transport roller pair 44 provided on the downstream side in the transport direction. The recording unit 24 is provided on the downstream side of the transport roller pair 44 in the transport direction. A carriage 46 is provided in the recording unit 24. The carriage 46 is configured to be movable in the X-axis direction, and a recording head 48 is provided below the carriage, as a "liquid ejecting head" that ejects ink as a liquid in the −Z direction.

A medium support portion 50 is provided below the recording head 48 in a region opposite to the recording head 48. The medium support portion 50 supports a lower surface (surface on a side opposite to a recording surface) of the medium P that is transported and reaches, by the transport roller pair 44, the region opposite to the recording head 48. The recording head 48 ejects the ink to the medium P supported by the medium support portion 50 and performs recording on the recording surface of the medium P.

A discharge roller pair 52 is provided on the downstream side of the recording head 48 in the transport direction. A medium receiving tray 54 is provided on the downstream side of the discharge roller pair 52 in the transport direction. A configuration of the medium receiving tray 54 is described below, and the medium receiving tray 54 comes into a medium unreceivable state in FIG. 2. A second transport route forming unit 56 is provided on the downstream side of the medium receiving tray 54, more specifically, on the side of the +Z direction. The second transport route forming unit 56 in the embodiment is configured as a curved inverting zone in which the medium is curved and inverted.

The medium fed from the recording unit 24 to the downstream side by the discharge roller pair 52 is guided to the second transport route forming unit 56 by the medium receiving tray 54 which is in the medium unreceivable state. The second transport route forming unit 56 causes the fed and reached medium to be curved and inverted and discharges the medium from a discharge port 58 provided on the downstream side of the second transport route forming unit 56 toward the support tray 22. At this time, the medium is discharged to the support tray 22 with a surface (first surface), on which recording is performed by the recording unit 24, facing downward.

In the embodiment, the second transport route 32 is configured as a face-down route through which the medium is discharged from the recording unit 24 toward the support tray 22 in a face-down state (state in which the recording surface faces downward) via the me the medium receiving tray 54 and the second transport route forming unit 56 which are in the medium unreceivable state.

A flap 60 is provided in the discharge port 58 of the housing 12. The flap 60 is configured to be rotatable with respect to the housing 12. In the embodiment, a plurality of flaps 60 are provided at intervals in the X-axis direction (FIG. 13).

In addition, after the recording is performed on the first surface (upper surface) of the medium in the recording unit 24, the transport roller pair 44 is reversed and the medium is transported to the upstream side in the transport direction in a case where recording is to be performed on a second surface (lower surface) on a side opposite to the first surface. The medium, which is transported to the upstream side in the transport direction, returns to the medium inverting unit 38 and is nipped between the inverting roller 40 and the driven roller 42*d*. The first surface and the second surface of the medium are inverted from each other by the inverting roller 40, the medium is again transported to the recording unit 24, recording is performed on the second surface in the recording unit 24, and then the medium is discharged to the support tray 22 through the second transport route 32.

Subsequently, FIG. 3 illustrates the medium transport from a rear feed unit 62. The rear feed unit 62 is provided at an end portion of the housing 12 on the side of the −Y direction. The rear feed unit 62 includes a feed port cover 64. The feed port cover 64 is configured to be rotatable with respect to the housing 12 and is capable of switching its state between a closed state (FIG. 2) and an opened state (FIG. 3). The feed port cover 64 comes into the opened state, and thereby it is possible to feed the medium from the rear feed unit 62 toward the recording unit 24 in the housing 12. A bold line to which a reference sign P1 is assigned in FIG. 3 represents a route of a medium P1 that is fed from the rear feed unit 62.

A feed roller 66 and a separation roller 68 are provided on the downstream side of the feed port cover 64. The medium set on the rear feed unit 62 is nipped by the feed roller 66 and the separation roller 68 and is joined to the medium transport route 28 on the downstream side of the feed roller 66 and the separation roller 68. Then, the medium is fed to the recording unit 24, is subjected to the recording, and is discharged to the support tray 22 through the second transport route 32.

Regarding Medium Receiving Tray

FIGS. 4 to 7 illustrate the medium receiving tray 54. As illustrated in FIG. 4, a first cover 70 is provided to be rotatable with respect to the housing 12 on a side surface of the housing 12 on the side of the +Y direction, that is on a front surface. The first cover 70 is configured to have a rotation point on a side of a lower end portion of the housing 12, and an end portion of the first cover 70 on the side of the +Z direction is configured as a free end.

As illustrated in FIG. 4, when the first cover 70 comes into an opened state, a part of the medium receiving tray 54 and the medium accommodating unit 26 is exposed. When the first cover 70 is in the opened state, it is possible to draw out a part of the medium accommodating unit 26 to the side of the +Y direction of the housing 12, and it is possible to easily supply the medium to the medium accommodating unit 26.

As illustrated in FIGS. 4 and 5, the medium receiving tray 54 is attached to be rotatable with respect to the housing 12 with a rotary shaft 54*a* (FIGS. 9A to 10B) as a rotation point. The medium receiving tray 54 is configured as a flat plate-shaped member provided to be extended in the X-axis direction, for example. The medium receiving tray is configured to be capable of switching its state between a medium receiving state (FIGS. 4 and 6) of receiving the medium and the medium unreceivable state (FIGS. 5 and 7). In FIGS. 4 and 6, in a case where the medium receiving tray 54 has the medium receiving state, the first transport route 30 (straight route) is formed, and the second transport route 32 comes into a non-formed state.

In the embodiment, the first transport route 30 is configured to be the face-up route for discharging the medium, with the first surface facing upward, without causing the medium subjected to the recording in the recording unit 24 to be curved and inverted. A bold line to which a reference sign P2 is assigned in FIG. 6 represents a route of a medium P2 that is discharged to the medium receiving tray 54 through the first transport route 30.

In FIGS. 5 and 7, in a case where the medium receiving tray 54 comes into the medium unreceivable state, the second transport route 32 is formed, and the first transport route 30 comes into a non-formed state. In the embodiment, the second transport route 32 is configured to be the face-down route for discharging the medium, with the first surface facing downward, by causing the medium subjected to the recording in the recording unit 24 to be curved and inverted. A bold line to which a reference sign P3 is assigned in FIG. 7 represents a route of a medium P3 that is discharged to the support tray 22 through the second transport route 32.

Further, in the embodiment, in FIGS. 6 and 7, a tray state detector 72 is provided on the housing 12. In the embodiment, the tray state detector 72 is configured as an optical sensor, for example; however, the tray state detector may be another type of sensor such as a mechanical or magnetic type of sensor. In the embodiment, the tray state detector 72 is set to come into a detecting state of the medium receiving tray 54 when the medium receiving tray 54 comes into the medium unreceivable state, and the tray state detector is set to come into a non-detecting state of the medium receiving tray 54 when the medium receiving tray 54 comes into the medium receiving state; however, the tray state detector may have an opposite setting.

A control unit (not illustrated) determines whether a discharge route in the medium transport route 28 is the first transport route 30 or the second transport route 32, based on a detection signal of the tray state detector 72 and determines a difference from setting of a discharge route input in the operating unit 20 or an external input unit. In a case where the route is different from the setting, the control unit performs an error display on a display portion of the operating unit 20, for example, or stops a recording operation on the medium. For example, in a case where an operation of error recovery is performed, and the state of the set route is coincident with the state of the detected route, the control unit restarts the recording operation on the medium.

FIGS. 9A to 10B illustrate a relationship between the first cover 70 and the medium receiving tray 54. A tray engaging portion 70*a* is formed at an end portion of the first cover 70 on a side of a −Y direction. In FIG. 9A, when the first cover 70 is switched from the opened state to the closed state, the tray engaging portion 70*a* comes into contact with an engagement target portion 54*b* of the medium receiving tray 54 on the side of the +Y direction. In FIG. 9B, in a state in which the tray engaging portion 70*a* comes into contact with the engagement target portion 54*b* and is further rotated in a direction in which the first cover 70 is closed (the side in the −Y direction), the tray engaging portion 70*a* pushes up the engagement target portion 54*b* in the +Z direction.

Further, as illustrated in FIG. 10A, when the tray engaging portion 70*a* is rotated in the direction in which the first cover 70 is closed, the medium receiving tray 54 is displaced to come into the medium unreceivable state from the medium receiving state with the rotary shaft 54*a* as the rotation point. Further, as illustrated in FIG. 10B, when the first cover 70 comes into a completely closed state with respect to the housing 12, the tray engaging portion 70*a* supports the medium receiving tray 54, which is switched to the medium unreceivable state, from a side of a −Z direction.

Regarding Relationship Between Configurations in Housing

A dashed line, to which a reference sign 74 is assigned, in FIG. 11 represents a position at which an ink containing unit 74 as the "liquid containing unit" is disposed in the housing 12. The ink containing unit 74 in FIG. 1 is positioned at an end portion of the housing 12 on a side of a −X direction at an end portion of the housing on the side of the +Y direction. The ink containing unit 74 has a configuration in which a part thereof is exposed on the side of the front surface of the housing 12, and thus it is possible to visually check an amount of ink contained in the ink containing unit 74. In the embodiment, the ink containing unit 74 is configured to be able to be refilled with ink.

Again, in FIG. 11, the ink containing unit 74 overlaps a zone in the second transport route 32 in the Y-axis direction, in which curvature and inversion are performed, and a part of the second transport route forming unit 56 in a range of a region A.

The medium accommodating unit 26 is provided on the side of a −Z direction of the first transport route 30 in FIG. 6. The medium inverting unit 38 in FIG. 2 is disposed on the side of the −Y direction (the rear side) in the housing 12. In the embodiment, the first transport route 30, the second transport route 32, the medium receiving tray 54, and a cover 78 to be described below constitutes a medium transport device 76.

Regarding Unjamming

Subsequently, FIG. 12 illustrates unjamming of the printer 10 in the embodiment. As illustrated in FIGS. 12 and 13, the support tray 22 is configured to be rotatable with respect to the housing 12 and is capable of switching its state between a closed state (FIGS. 1 to 3) and an opened state (FIGS. 12 and 13). The supports 12*a* on the side of the −X direction is omitted in FIG. 13.

As illustrated in FIGS. 12 and 13, when the support tray 22 comes into the opened state with respect to the housing 12, the inside of the housing 12, specifically, a route from the recording unit 24 to the discharge roller pair 52 is exposed. In this manner, it is possible to easily perform the unjamming of the medium which occurs in the inside of the housing 12.

Subsequently, in FIGS. 12 and 14, the cover 78 is provided on the side of the front surface of the housing 12 and is rotatable with respect to the housing 12. The cover 78 has a configuration in which a lower portion of the cover 78 is the rotation center, and an upper portion thereof is a rotatable free end. The cover 78 is configured to include the first cover 70 that is positioned on the side of the −Z direction in the closed state with respect to the housing 12 (FIGS. 1, 13, and the like) and a second cover 80 that is positioned on the side of the +Z direction of the first cover 70.

In FIG. 14, a second transport route forming member 56*a*, which is a part of the second transport route forming unit 56, is provided on a side of the second cover 80 opposite to the housing 12. On the other hand, a second transport route forming member 56*b*, which is a part of the second transport route forming unit 56, is provided on the side of the housing 12. When the cover 78 comes into the closed state with respect to the housing 12, the second transport route forming member 56*a* and the second transport route forming member 56*b* are opposite to each other with an interval therebetween and constitute the second transport route forming unit 56 which is the curved inverting zone of second transport route 32.

As illustrated in FIG. 14, when the cover 78 is opened, the second transport route 32 and the second transport route forming members 56*a* and 56*b* constituting the curved inverting zone of the second transport route 32 are exposed. In FIG. 14, when the medium receiving tray 54 is switched from the medium unreceivable state to the medium receiving state (states in FIGS. 4 and 6), the first transport route 30 is formed, and thus it is possible to also expose the first transport route 30.

In the embodiment, as illustrated in FIGS. 4 and 5, the first cover 70 is configured to be openable independently from the second cover 80. On the other hand, the second cover 80 forms a part of the second transport route 32 in the closed state, specifically, the second transport route forming unit 56 which is the curved inverting zone.

In FIG. 14, a cover state detector 82 is provided at a position opposite to the cover 78 which is in the closed state in the upper portion of the housing 12. In the embodiment, the cover state detector 82 is configured as an optical sensor, for example; however, the cover state detector may be another type of sensor such as a mechanical or magnetic type of sensor. In the embodiment, the cover 78 is closed with respect to the housing 12, and thereby the cover state detector 82 is set to detect the cover 78.

In FIG. 8, a locking unit 84 is provided between the first cover 70 and the second cover 80. In FIG. 8, the locking unit 84 includes a lock pin 86, a spring member 88, and a pressing portion 90. In the embodiment, the lock pin 86 and the spring member 88 are provided on the side of the second cover 80, for example. The spring member 88 causes the lock pin 86 to project toward the side of the first cover 70. The pressing portion 90 is provided on the side of the first cover 70. In FIG. 8, the lock pin 86 enters an inside of the pressing portion 90, the first cover 70 and the second cover 80 are locked, and an engagement state between the first cover 70 and the second cover 80 is maintained.

The embodiment employs a configuration in which the lock pin 86 and the spring member 88 are provided on the side of the second cover 80, and the pressing portion 90 is provided on the side of the first cover 70; however, as illustrated in FIGS. 4 and 5, a configuration in which the lock pin 86 and the spring member 88 are provided on the side of the first cover 70, and the pressing portion 90 is provided on the side of the second cover 80 may be employed.

In this manner, when the second cover 80 is opened with respect to the housing 12, the first cover 70 rotates to the side of the +Y direction with respect to the housing 12 in conjunction with the second cover 80, and the cover 78 comes into the opened state with respect to the housing 12.

On the other hand, when there is an attempt to open the first cover 70 in a state in which the cover 78 is in the closed state with respect to the housing 12, the lock pin 86 is pushed up to the side of the +Z direction along an inclined surface 90*a* provided on the pressing portion 90, and the locking unit 84 is unlocked from a locking state. As a result, while the second cover 80 maintains the closed state with respect to the housing 12, the first cover 70 is openable independently with respect to the housing 12.

Modification Example of First Embodiment (1) The embodiment employs a configuration in which the locking unit 84 is provided at the center of the cover 78 in the X-axis direction; however, a plurality of locking units 84 may be provided on the cover 78 and, in this case, a configuration in which the plurality of locking units are arranged at appropriate intervals in the X-axis direction may be employed.

(2) The embodiment employs a configuration in which the cover 78 or the first cover 70 is rotatable with respect to the housing 12; however, instead of the configuration, a configuration in which the cover 78, the first cover 70, and the second cover 80 are attachable to and detachable from the housing 12 may be employed.

(3) In FIGS. 15 and 16, in the embodiment, an extension tray 92 may be provided on the medium receiving tray 54. Specifically, as illustrated in FIG. 15, the extension tray 92 is attached to a lower surface 54*c* of the medium receiving tray 54. The extension tray 92 is configured to be rotatable with respect to the medium receiving tray 54 with a direction, which intersects with the lower surface 54*c* of the medium receiving tray 54, for example, a direction, which is orthogonal to the lower surface, as a rotation axis. In the embodiment, when the medium receiving tray 54 is in the medium receiving state, the extension tray 92 is capable switching its state between a housed state of being housed along the lower surface 54*c* of the medium receiving tray 54 illustrated in FIG. 15 and a projecting state of projecting to the side of the +Y direction of the medium receiving tray 54 by being rotated with respect to the medium receiving tray 54 in the +Y-axis direction illustrated in FIG. 16.

Further, in the embodiment, the extension tray 92 includes an extension tray main body 92*a* and a sub-tray 92*b*. The sub-tray 92*b* is configured to be rotatable with respect to the extension tray main body 92*a* and is capable of switching its state between a state (not illustrated) of being housed in the extension tray main body 92*a* and an unfolded state (FIG. 16) in which the sub-tray rotates with respect to the extension tray main body 92*a* such that a medium receiving surface is extended. In this manner, in the medium receiving tray 54, the medium receiving surface can be more extended in the +Y-axis direction than the extension tray 92.

Two arrows in FIG. 16 schematically illustrates an operation of the extension tray 92, which is performed when the extension tray 92 is rotated from the medium receiving tray 54 so as to switch its state from the housed state to the projecting state, and an operation of the sub-tray 92*b* that switches its state from the state, in which the sub-tray 92*b* is housed in the extension tray main body 92*a*, to the unfolded state.

To summarize the above description, the medium transport device 76 includes the first transport route 30 for discharging the medium processed by the recording unit 24, the second transport route 32 for discharging the medium processed by the recording unit 24, and the medium receiving tray 54 that is capable of switching its state between the medium receiving state of receiving the medium that is discharged through the first transport route 30 and the medium unreceivable state obtained by switching the state from the medium receiving state. The first transport route 30 comes into the non-formed state and at least a part of the medium receiving tray 54 forms the second transport route 32 when the medium receiving tray 54 is in the medium unreceivable state, and the second transport route 32 comes into the non-formed state and the first transport route 30 is formed when the medium receiving tray 54 comes into the medium receiving state.

In the configuration, the state of the medium receiving tray 54 is switched, and thereby it is possible to switch the state between non-forming of the first transport route 30 and forming of the second transport route 32 and non-forming of the second transport route 32 and forming of the first transport route 30, that is, the medium receiving tray 54 is used as a route switching member. In this manner, it is possible to realize the switching of the transport route, with an increase in cost and an increase in size of the apparatus being suppressed.

The rotation of the medium receiving tray 54 causes the state to be switched between the medium unreceivable state and the medium receiving state.

The medium receiving tray 54 includes at least one extension tray 92 that causes the medium receiving surface, which receives the medium discharged through the first transport route 30, to be extended. In the configuration, it is possible to appropriately support a medium having a size larger than the medium receiving tray 54 in a medium transport direction.

The openable/closeable cover 78 is provided on a side surface, specifically, the front surface, of the housing 12 in which the recording unit 24 is provided, and the opening of the cover 78 causes the medium receiving tray 54 and at least a part of the second transport route forming unit 56, which is the zone on the second transport route 32 in which the medium is curved and inverted, to be exposed. In the configuration, the opening of the cover 78 enables both of access to the medium receiving tray 54 and access to the second transport route forming unit 56 which is the zone of the second transport route 32 in which the medium is curved and inverted, and thus it is possible to easily perform unjamming work when a jam occurs.

The cover 78, more specifically, the first cover 70, is provided with the tray engaging portion 70*a* that supports the medium receiving tray 54 in the state in which the cover 78 or the first cover 70 is in the closed state such that the medium unreceivable state of the medium receiving tray 54 is maintained and pushes up the medium receiving tray 54 which is in the medium receiving state when the cover 78 or the first cover 70 is closed from the opened state such that the state is switched to the medium unreceivable state.

In the configuration, since the state of the medium receiving tray 54 is switched in conjunction with the opening/closing operation of the cover 78 or the first cover 70, the operability by the user improves. In addition, since the tray engaging portion 70*a* supports the medium receiving tray 54 in the state in which the cover 78 or the first cover 70 is closed, the medium unreceivable state of the medium receiving tray 54 is reliably maintained.

The printer 10 includes the cover state detector 82 that detects the opened/closed state of the cover 78. In the configuration, the opened/closed state of the cover 78, that is, the state of the medium receiving tray 54, is found, and thereby it is possible to select an appropriate transport route.

The medium transport device 76 includes the first transport route 30 for discharging the medium processed by the recording unit 24 to the outer side of the housing 12, in which the recording unit 24 is provided, and the second transport route 32 for discharging the medium processed by the recording unit 24 to the outer side of the housing 12. The housing 12 includes an openable/closeable or detachable cover 78, and opening or detaching of the cover 78 causes at least one of the first transport route 30 and the medium receiving tray 54, which is the route forming member constituting the first transport route 30, and at least one of the second transport route 32 and the second transport route forming members 56*a* and 56*b*, which are the route forming members constituting the second transport route 32, to be exposed.

In the configuration, the first transport route 30 and the second transport route 32, which is different from the first transport route 30, are provided, and thus the opening or detaching of one cover 78 causes at least one of the first transport route 30 and the medium receiving tray 54 constituting the first transport route 30 and at least one of the second transport route 32 and the second transport route forming members 56*a* and 56*b* constituting the second transport route 32 to be exposed. Therefore, the opening of the cover 78 enables both of the first transport route 30 to be visually recognized or the first transport route 30 to be accessed and the second transport route 32 to be visually recognized or the second transport route 32 to be accessed, and thus it is possible to still more easily perform the unjamming work.

The first transport route 30 is the transport route through which the medium P is discharged, with the first surface thereof facing upward without being curved or inverted, from the recording unit 24 to the outer side of the housing 12, and the second transport route 32 is the transport route through which the medium P processed by the recording unit 24 is fed toward the upper side, is curved and inverted, and is discharged, with the first surface thereof facing downward, to the outer side of the housing 12.

The opening of the cover 78 causes at least a part of the second transport route forming unit 56 which is the zone of the second transport route 32, in which the medium P is curved and inverted, to be exposed. In the configuration, the opening of the cover 78 causes at least a part of the second transport route forming unit 56 which is the zone of curvature and inverting, in which jam is likely to occur, more specifically, the second transport route forming members 56*a* and 56*b*, to be exposed. Therefore, it is possible to more easily and efficiently perform the unjamming.

The cover 78, specifically, an inner side of the second cover 80, forms a part of the second transport route 32. In the configuration, the second transport route forming member 56*a* that forms a part of the second transport route 32 is provided on the inner side of the second cover 80, and thus it is possible to achieve a reduction in the number of constitutional members and low costs.

The cover 78 is positioned on the side surface of the housing 12, has the rotation center on the lower side and the rotatable free end on the upper side, and is opened and closed by rotating.

The medium accommodating unit 26 is provided on the lower side of the first transport route 30 and accommodates the medium. The cover 78 is configured to include the first cover 70 that is positioned on the lower side and the second cover 80 that is positioned on the upper side from the first cover 70. The second transport route 32 is formed by closing the second cover 80. The first cover 70 can be independently opened and closed, and the opening of the first cover 70 enables the medium to be accommodated in the medium accommodating unit 26.

In the configuration, the cover 78 is configured to include the first cover 70 and the second cover 80, the second transport route 32 is formed by closing the second cover 80, the first cover 70 is independently openable (regardless of the opening of the second cover 80), and the opening of the first cover enables the medium to be accommodated in the medium accommodating unit 26. Therefore, it is possible to accommodate the medium in the medium accommodating unit 26 in a state in which it is possible to transport the medium by using the second transport route 32, and thus operability by a user improves.

The first cover 70 is capable of engaging with the second cover 80, and the first cover 70 is opened in conjunction with opening of the second cover 80. In the configuration, the opening of the second cover 80 causes the first cover 70 to be opened, and thereby the inside of the apparatus is exposed to a large extent. Therefore, it is possible to still more improve the workability at the time of the unjamming.

The support tray 22 is provided above the housing 12 and supports the medium which is discharged through the second transport route 32. The support tray 22 is openable and closeable, and the opening of the support tray causes the inside of the housing 12 to be exposed. In the configuration, the workability of the unjamming improves when the jam occurs inside the housing 12.

The medium receiving tray 54 is provided to support the medium which is discharged through the first transport route 30. The medium receiving tray 54 is openable and closeable, comes into the state of supporting the medium which is discharged through the first transport route 30 when the tray is opened, and comes into the state of forming the second transport route 32 when the tray is closed. In the configuration, the medium receiving tray 54 is used as the route switching member, and thereby it is possible to realize the switching of the transport route, with an increase in cost and an increase in size of the apparatus being suppressed.

Second Embodiment

FIGS. 17 to 18 illustrate a second embodiment of a medium tray. A medium receiving tray 94 according to the second embodiment is configured to be movable by sliding with respect to the housing 12 in the Y-axis direction. Specifically, the medium receiving tray 94 is housed in the housing 12 and is displaceable between a second position, at which the medium receiving tray comes into a medium unreceivable state (FIG. 17) of forming a second transport route 96, and a first position, at which the medium receiving tray comes into a medium receiving state (FIG. 18) of projecting to the side of the +Y direction from the housing 12 and forming a first transport route 98.

The medium receiving tray 94 includes a support surface 94*a* and a projecting portion 94*b* that projects in the +Z direction at an end portion of the support surface 94*a* on the side of the +Y direction and is extended in the X-axis direction. The projecting portion 94*b* is provided with a guide surface 94*c* for guiding the medium, on which the recording is performed by the recording unit 24 and which is fed to the downstream side in the transport direction by the discharge roller pair 52, to the second transport route forming unit 56 when the medium receiving tray 94 is in the medium unreceivable state (FIG. 17).

A bold line to which a reference sign P4 is assigned in FIG. 17 represents a route of a medium P4 that is discharged to the support tray 22 through the second transport route 96 in the embodiment. In the embodiment, the medium P4 fed out to the downstream side by the discharge roller pair 52 is discharged, with the first surface facing downward, to the support tray 22 through the guide surface 94*c* of the projecting portion 94*b* of the medium receiving tray 94, which forms a part of the second transport route 96 in the medium unreceivable state (second position), and the second transport route forming unit 56 which is the curved inverting zone.

On the other hand, as illustrated in FIG. 18, when the medium receiving tray 94 projects to the side of the +Y direction of the housing 12 and comes into the medium receiving state (first position), a medium P5 fed out from the discharge roller pair 52 is not guided to the second transport route forming unit 56 but is guided toward the support surface 94*a* of the medium receiving tray 94. A bold line to which a reference sign P5 is assigned in FIG. 18 represents a route of the medium P5 that is discharged to the medium receiving tray 94 through the first transport route 98.

The sliding of the medium receiving tray 94 causes the state thereof to be switched between the medium unreceivable state and the medium receiving state.

The projecting portion 94*b* that projects from the support surface 94*a* which supports the medium in the medium receiving tray 94 is provided on the side of the +Y direction of the medium receiving tray 94, and the projecting portion 94*b* forms the second transport route 96 when the medium receiving tray 94 is in the medium unreceivable state.

In the configuration, the projecting portion 94*b* provided on the medium receiving tray 94 suppresses sliding off of the medium that is discharged to the medium receiving tray 94. When the medium receiving tray 94 is in the medium unreceivable state, the projecting portion 94*b* forms the second transport route 96, and thus it is possible to achieve a reduction in the number of members and suppressing of an increase in cost.

The medium receiving tray 94 is provided to support the medium that is discharged through the first transport route 98, and the medium receiving tray 94 is slidable between the first position, at which the tray projects from the housing 12, and the second position, at which the tray is housed in the housing 12, comes into the state of supporting the medium which is discharged through the first transport route 98 by being positioned at the first position, and comes into the state of forming the second transport route 96 by being positioned at the second position.

In this configuration, the medium receiving tray 94 is slidable, and the sliding causes the medium receiving tray to come into the state of supporting the medium which is discharged through the first transport route 98 or come into the state of forming the second transport route 96. Therefore, the medium receiving tray 94 is used as the route switching member, and thereby it is possible to realize the switching of the transport route, with an increase in cost and an increase in size of the apparatus being suppressed.

Third Embodiment

FIGS. 19 to 20 illustrate a third embodiment of the medium tray. A medium receiving tray 100 according to the third embodiment is configured to be movable by sliding with respect to the housing 12 in the Y-axis direction. The medium receiving tray 100 is configured to be displaceable between a medium unreceivable state, in which the medium receiving tray is housed in the housing 12 illustrated in FIG. 19, and a medium receiving state in which the medium receiving tray projects to the side of the +Y direction from the housing 12 illustrated in FIG. 20.

In the embodiment, the medium receiving tray 100 includes a support surface 100*a* and a projecting portion 100*b* that projects in the +Z direction at an end portion of the support surface 100*a* on the side of the +Y direction and is extended in the X-axis direction. The projecting portion 100*b* is provided with an inclined surface 100*c*.

Further, a route forming member 102 is provided on the downstream side of the discharge roller pair 52. The route forming member 102 is configured to be rotatable with respect to the housing 12.

In FIG. 19, when the medium receiving tray 100 comes into the medium unreceivable state, the route forming member 102 engages with the inclined surface 100*c* of the projecting portion 100*b* of the medium receiving tray 100. In this manner, the route forming member 102 comes into a first state in which the route forming member forms a second transport route 104 and a first transport route 106 is in a non-formed state.

When the route forming member 102 comes into the first state, a medium P6 fed from the discharge roller pair 52 is guided to the second transport route forming unit 56 by the route forming member 102 in the second transport route 104, is curved and inverted by the second transport route forming unit 56, and is discharged to the support tray 22. A bold line to which a reference sign P6 is assigned in FIG. 19 represents a route of the medium P6 that is discharged to the support tray 22 through the second transport route 104.

In FIG. 20, when the medium receiving tray 100 comes into the medium receiving state, the route forming member 102 comes into a state of being released from an engagement state with the inclined surface 100*c* of the projecting portion 100*b* and of falling to the side of the support surface 100*a*. In this manner, the route forming member 102 comes into a second state in which the route forming member forms a first transport route 106 and the second transport route 104 is in a non-formed state.

When the route forming member 102 comes into the second state, a medium P7 fed from the discharge roller pair 52 is discharged to the support surface 100*a* of the medium receiving tray 100 through the upper side of the route forming member 102 in the first transport route 106. A bold line to which a reference sign P7 is assigned in FIG. 20 represents a route of the medium P7 that is discharged to the medium receiving tray 100 through the first transport route 106.

The medium transport device includes the first transport route 106 for discharging the medium processed by the recording unit 24, the second transport route 104 for discharging the medium processed by the recording unit 24, the medium receiving tray 100 that is capable of switching its state between the medium receiving state of receiving the medium that is discharged through the first transport route 106 and the medium unreceivable state obtained by switching the state from the medium receiving state, and the route forming member 102 that is capable of switching its state between the first state, in which the second transport route 104 is formed and the first transport route 106 is in the non-formed state, and the second state, in which the first transport route 106 is formed and the second transport route 104 is in the non-formed state. The route forming member 102 is supported by the medium receiving tray 100 and comes into the first state when the medium receiving tray 100 is in the medium unreceivable state, and the route forming member is released from the support by the medium receiving tray 100 and comes into the second state when the medium receiving tray 100 is in the medium receiving state.

In the configuration, the state of the medium receiving tray 100 is switched, and thereby the state of the route forming member 102 is switched. Therefore, there is no need to provide a power source for operating the route forming member 102, and thereby it is possible to realize the switching of the transport route, with an increase in cost and an increase in size of the apparatus being suppressed.

Fourth Embodiment

FIGS. 21 to 22 illustrate a support tray according to a fourth embodiment. A support tray 108 according to the embodiment is configured to be attachable to and detachable from a housing 110. FIG. 21 illustrates a state in which the support tray 108 is attached to the housing.110, and FIG. 22 illustrates a state in which the support tray 108 is detached from the housing.110. The supports 12*a* and the scanner 14 are omitted in FIGS. 21 and 22.

In the embodiment, the support tray 108 is formed integrally to a route forming member 114 that forms a part of a curved inverting zone of a second transport route 112. As illustrated in FIG. 22, when the support tray 108 is detached from the housing 110, the route forming member 114 formed integrally to the support tray 108 is together detached from the housing 110. As a result, the route forming member 114 and a route forming member 116 constituting the curved inverting zone of the second transport route 112 are exposed in the housing 110. In this manner, at least a part of the curved inverting zone of the second transport route 112 is exposed.

Further, in the embodiment, as illustrated in FIG. 22, when the support tray 108 and the route forming member 114 are detached from the housing 110, a part of the medium receiving tray 54 constituting the second transport route 112 is also exposed. In this state, for example, when the cover 78 or the first cover 70 is opened, and the state is switched from the medium unreceivable state in which the medium receiving tray 54 constitutes the second transport route 112 to the medium receiving state (FIGS. 4 and 6) in which the medium receiving tray constitutes the first transport route (straight route), a part of the first transport route is also exposed when viewed from above the housing 110.

The support tray 108 is provided above the housing 110 and supports the medium which is discharged through the second transport route 112. The support tray 108 is attachable to and detachable from the housing 110 and is configured integrally to the route forming member 114 constituting the second transport route 112. Detaching of the support tray 108 causes the route forming member 114 to be detached and causes at least a part of the zone of the second transport route 112, in which the medium is curved and inverted, specifically, the route forming member 114 and the route forming member 116 constituting the curved inverting zone, to be exposed.

In the configuration, the detaching of the support tray 108 causes the route forming member 114 to be detached, and thereby at least a part of the zone of curvature and inverting, in which jam is likely to occur, to be exposed. Therefore, it is possible to more easily and efficiently perform the unjamming.

Fifth Embodiment

FIG. 23 illustrates a configuration of unjamming in a fifth embodiment. Configurations are based on the third embodiment, and the description is provided in which the same reference signs as those in the third embodiment are assigned to the same configurations as those in the third embodiment. The description is provided in which the same reference signs are also assigned to the same configurations in sixth to twelfth embodiments.

In the embodiment, a support tray 118 is configured to be rotatable. In the embodiment, the support tray 118 is configured to be capable of switching its state between a support state (a solid line portion) of supporting the medium discharged from a second transport route 120 and a state (a two-dot chain line portion to which a reference sign 118-1 is assigned) of rotating from the support state to the side of the +Z direction. In the embodiment, the support tray 118 rotates with the downstream side of the medium in the transport direction as the rotation point.

A second transport route forming unit 122 constituting the curved inverting zone is provided on the second transport route 120. The second transport route forming unit 122 includes a second transport route forming member 122*a* and a second transport route forming member 122*b*. In the embodiment, the second transport route forming member 122*a* is configured to be rotatable. Specifically, the second transport route forming member 122*a* is opposite to the second transport route forming member 122*b* with an interval therebetween and is capable of switching its state between a route forming state (a solid line portion) of forming the second transport route forming unit 122 and a route open state (a two-dot chain line portion to which a reference sign 122*a*-1 is assigned) of rotating from the route forming state to the side in the +Y-axis direction.

In the configuration, the support tray 118 rotates, thereby making it possible to have an access to the inside of the apparatus, and thus it is possible to easily perform the unjamming. Additionally, the second transport route forming member 122*a* comes into the route open state, thereby making it possible to cause at least a part of the curved inverting zone of the second transport route 120 to be open, and it is possible to easily perform the unjamming.

Sixth Embodiment

FIG. 24 illustrates a configuration of unjamming in the sixth embodiment. The embodiment differs from the fifth embodiment in that the support tray does not rotate but is slidable in the transport direction. The other configurations are the same as those of the fifth embodiment.

A support tray 124 according to the embodiment is configured to be capable of switching its state between a support state (a solid line portion) of supporting the medium transported along the second transport route 120 and an open state (a two-dot chain line portion to which a reference sign 124-1 is assigned) of sliding from the support state toward the downstream side of the medium in the transport direction.

In the configuration, the support tray 124 is caused to slide so as to come into the open state, thereby making it possible to have an access to the inside of the apparatus, and thus it is possible to easily perform the unjamming. Additionally, the second transport route forming member 122*a* comes into the route open state, thereby making it possible to cause at least a part of the curved inverting zone of the second transport route 120 to be open, and it is possible to easily perform the unjamming.

Seventh Embodiment

FIG. 25 illustrates a configuration of unjamming in the seventh embodiment. In the embodiment, a support tray 126, a second transport route forming unit 128, and a flap 130 constitute a unit body 132. In the embodiment, the unit body 132 is configured to be attachable to and detachable from a housing 134. Specifically, the unit body 132 is capable of switching its state between an installed state (a solid line portion) of being installed in the housing 134 and forming the second transport route 120 and a route open state (a two-dot chain line portion to which a reference sign 132-1 is assigned) of being detached from the housing 134.

In the configuration, since the second transport route 120 and the route forming member 102 are exposed by performing an operation, in which the unit body 132 is detached from the housing 134, once, it is possible to achieve good workability by a user, and thus it is possible to easily perform the unjamming.

Eighth Embodiment

FIG. 26 illustrates a configuration of unjamming in the eighth embodiment. In the embodiment, a support tray 136 is configured to be rotatable with respect to a housing 138. The support tray 136 is configured to be capable of switching its state between a support state (a solid line portion) of supporting the medium discharged from the second transport route 120 and a state (a two-dot chain line portion to which a reference sign 136-1 is assigned) of rotating from the support state to the side of the +Z direction. In the embodiment, the support tray 136 rotates with the downstream side of the medium in the transport direction as the rotation point.

In the embodiment, a second transport route forming unit 140 and a flap 142 constitute a unit body 144. In the embodiment, the unit body 144 is configured to be attachable to and detachable from the housing 138. Specifically, the unit body 144 is capable of switching its state between an installed state (a solid line portion) of being installed in the housing 138 and forming the second transport route 120 and a route open state (a two-dot chain line portion to which a reference sign 144-1 is assigned) of being detached from the housing 138.

In the configuration, the support tray 136 rotates, thereby making it possible to have an access to the inside of the housing 138, and thus it is possible to easily perform the unjamming. Additionally, since the second transport route 120 and the route forming member 102 are exposed by only detaching the unit body 144 from the housing 138, it is possible to easily perform the unjamming.

Ninth Embodiment

FIG. 27 illustrates a configuration of unjamming in the ninth embodiment. In the embodiment, a configuration in which the unit body rotates to the side of the +Y direction (the side of the front surface) of the housing 138 is employed, instead of the configuration in which the unit body 144 (a unit body 146 in FIG. 27) is attachable to and detachable from the housing 138 in the eighth embodiment. The unit body 146 has the same configuration as that of the unit body 144.

In the configuration, the support tray 136 rotates, thereby making it possible to have an access to the inside of the housing 138, and thus it is possible to easily perform the unjamming. Further, since the second transport route 120 and the route forming member 102 are exposed by only rotating the unit body 146 to the side of the front surface of the housing 138, it is possible to easily perform the unjamming. Additionally, since the configuration in which the unit body 146 is rotated with respect to the housing 138 is employed, it is possible to easily return from a rotating state to the route forming state.

Tenth Embodiment

FIG. 28 illustrates a configuration of unjamming in the tenth embodiment. The embodiment differs from the fifth embodiment in that a flap 148 is rotated along with the route forming member to the side of the +Y direction of the housing. The other configurations are the same as those of the fifth embodiment.

In the embodiment, a second transport route forming unit 150 includes a second transport route forming member 150*a* and a second transport route forming member 150*b*. In the embodiment, the flap 148 and the second transport route forming member 150*a* form a unit body 152. The unit body 152 is capable of switching its state between a route forming state (a solid line portion) of forming the second transport route 120 and a route open state (a two-dot chain line portion to which a reference sign 152-1 is assigned) of rotating to the side of the +Y direction with respect to the housing 138.

In the configuration, the support tray 118 rotates, thereby making it possible to have an access to the inside of the apparatus, and thus it is possible to easily perform the unjamming. Further, since the second transport route 120, the curved inverting zone of the second transport route 120, and the route forming member 102 are exposed by only rotating the unit body 146 to the side of the front surface of the housing 138, it is possible to easily perform the unjamming.

Eleventh Embodiment

FIG. 29 illustrates a configuration of unjamming in the eleventh embodiment. The embodiment is obtained by modifying some configurations of the ninth embodiment illustrated in FIG. 27. Therefore, the description is provided in which the same reference signs are assigned to the same configurations as those of the ninth embodiment. In the embodiment, the support tray 136 is configured to be rotatable with respect to a housing 138. The support tray 136 is configured to be capable of switching its state between the support state (a solid line portion) of supporting the medium discharged from the second transport route 120 and the state (a two-dot chain line portion to which a reference sign 136-1 is assigned) of rotating from the support state to the side of the +Z direction. In the embodiment, the support tray 136 rotates with the downstream side of the medium in the transport direction as the rotation point.

In the embodiment, a second transport route forming unit 154 includes a second transport route forming member 154*a*, a second transport route forming member 154*b*, and a second transport route forming member 154*c*. In the embodiment, the second transport route forming member 154*b* and the second transport route forming member 154*c* constitute a route on an inner circumferential side of the second transport route forming unit 154 which is the curved inverting zone.

In the embodiment, the second transport route forming member 154*a*, the second transport route forming member 154*b*, and a flap 156 constitute a unit body 158. In the embodiment, the unit body 158 is configured to be rotatable with respect to the housing 138. The unit body 158 is capable of switching its state between a route forming state (a solid line portion) of forming the second transport route 120 and a route open state (a two-dot chain line portion to which a reference sign 158-1 is assigned) of rotating to the side of the +Y direction with respect to the housing 138.

In the configuration, the support tray 136 rotates, thereby making it possible to have an access to the inside of the housing 138, and thus it is possible to easily perform the unjamming. Further, since the second transport route 120 and the route forming member 102 are exposed by only rotating the unit body 158 with respect to the housing 138, it is possible to easily perform the unjamming.

In the first to eleventh embodiments, the tray state detector 72 that detects the state of the medium receiving tray 54, 94, or 100 is provided. In the configuration, the state of the medium receiving tray 54, 94, or 100 is found, and thereby it is possible to select an appropriate transport route.

In the first to eleventh embodiments, the printer 10 performs the recording on the medium and includes the recording unit 24 and the medium transport device 76.

In the first to eleventh embodiments, the first transport route 30, 98, or 106 is the transport route through which the medium is discharged, with the first surface thereof facing upward without being curved or inverted, from the recording unit 24 to the outer side of the housing 12, 110, 134, or 138, in which the recording unit 24 is provided, and the second transport route 32, 96, 104, 112, or 120 is the transport route through which the medium processed by the recording unit 24 is fed toward the upper side, is curved and inverted, and is discharged, with the first surface thereof facing downward, to the outer side of the housing 12, 110, 134, or 138.

In the first to eleventh embodiments, the recording unit 24 includes a recording head 48 that performs the recording on the medium by ejecting the ink. The ink containing unit 74 that contains the ink which is ejected from the recording head 48 is provided on the front surface that is one of the side surfaces of the housing 12, 110, 134, or 138. The ink containing unit 74 and the second transport route forming unit 56, 122, 128, 140, 150, or 154 which is the zone of the second transport route 32, 96, 104, 112, or 120, in which the medium is curved and inverted, overlap each other by at least a part thereof in the apparatus depth direction in the region A. In the configuration, it is possible to suppress the dimension in the apparatus depth direction.

In the first to eleventh embodiments, the medium accommodating unit 26 that accommodates the medium is provided below the first transport route 30, 98, or 106, and the medium inverting unit 38 is provided to invert the medium fed from the medium accommodating unit 26 and to transport the medium to the recording unit 24, or to invert the medium, on which the recording is performed by the recording unit 24 and which is fed back, and to again transport the medium to the recording unit 24. The medium inverting unit 38 is provided to be close to the rear surface on the side opposite to the front surface which is one of the side surfaces of the housing 12, 110, 134, or 138.

In the first to eleventh embodiments, the printer 10 performs the recording on the medium and includes the recording unit 24 and the medium transport device 76. The recording unit 24 includes the recording head 48 that performs the recording on the medium by ejecting the ink, and the ink containing unit 74 that contains the ink which is ejected from the recording head 48 is provided in the front surface which is one of the side surfaces of the housing 12, 110, 134, or 138. The ink containing unit 74 and the second transport route forming unit 56, 122, 128, 140, 150, or 154 that is the zone of the second transport route 32, 96, 104, 112, or 120, in which the medium is curved and inverted, overlap each other by at least a part thereof in the apparatus depth direction in the region A. In the configuration, it is possible to suppress the dimension in the apparatus depth direction.

Modification Examples of First to Eleventh Embodiments

In the embodiment, the processing unit is configured as the recording unit 24; however, the processing unit may be configured as an image reading unit instead of the configuration. The configuration of the embodiment may be applied to a scanner.

In addition, in the embodiment, the medium receiving tray 54, 94, or 100 according to the invention and the configuration of the unjamming in the fourth to eleventh embodiments are applied to the ink jet printer as an example of the recording apparatus; however, the medium receiving tray and the configuration of the unjamming can be applied to another common liquid ejecting apparatus.

Here, examples of the liquid ejecting apparatus are not limited to a recording apparatus such as a printer, a copy machine, a facsimile, or the like in which an ink jet type recording head is used, an ink is ejected from the recording head, and recording is performed on a recording medium, but include an apparatus in which, instead of the ink, a liquid corresponding to an application is ejected from a liquid ejecting head corresponding to the ink jet type recording head on an ejecting medium corresponding to the recording medium and the liquid is attached to the ejecting medium.

Examples of other liquid ejecting heads include, in addition to the recording head, a color material ejecting head that is used in manufacturing a color filter of a liquid crystal display or the like, an electrode material (conductive paste) ejecting head that is used in forming electrodes of an organic EL display, a field emission display (FED), or the like, a bioorganic material ejecting head that is used in manufacturing a biochip, a sample ejecting head as an accuracy pipette, or the like.

The invention is not limited to the examples, various modifications can be performed within a range of the invention described in the claims, and it is needless to say that the modifications are also included in the range of the invention.

The entire disclosure of Japanese Patent Application No. 2017-188565, filed Sep. 28, 2017 is expressly incorporated by reference herein.

What is claimed is:

1. A medium transport device comprising:

a first transport route for discharging a medium processed by a processing unit, with a first surface facing upward;

a second transport route for discharging the medium processed by the processing unit, with the first surface facing downward; and a medium receiving tray that is configured to switch a state between a medium receiving state of receiving the medium that is discharged through at least a part of the first transport route and a medium unreceivable state, wherein the first transport route comes into a non-formed state and at least a part of the medium receiving tray forms the second transport route when the medium receiving tray is in the medium unreceivable state, and the second transport route comes into a non-formed state and the first transport route is formed when the medium receiving tray comes into the medium receiving state, wherein the medium receiving tray is disposed inside of a housing of the medium transport device when forming the first transport path and the second transport path, wherein the medium has the first surface facing upward when the medium is discharged onto the medium receiving tray using the first transport route, and wherein the medium has the first surface facing downward when the medium is discharged using the second transport route.

2. The medium transport device according to claim 1, wherein rotation of the medium receiving tray causes a state to be switched between the medium unreceivable state and the medium receiving state.

3. The medium transport device according to claim 2, wherein the medium receiving tray includes at least one extension tray that causes a medium receiving surface, which receives the medium discharged through the first transport route, to be extended.

4. The medium transport device according to claim 3, further comprising:

an openable/closeable cover that is provided on a side surface of a housing in which the processing unit is provided, wherein the medium receiving tray and at least a part of the second transport route are exposed by opening the cover.

5. The medium transport device according to claim 4, wherein the cover is provided with a tray engaging portion that supports the medium receiving tray in the state in which the cover is in the closed state such that the medium unreceivable state of the medium receiving tray is maintained and pushes up the medium receiving tray which is in the medium receiving state when the cover is closed from the opened state such that the state is switched to the medium unreceivable state.

6. A recording apparatus comprising:

a recording unit as the processing unit, which performs recording on a medium; and the medium transport device according to claim 5.

7. The medium transport device according to claim 4, further comprising:

a cover state detector that detects an opened/closed state of the cover.

8. A recording apparatus comprising:

a recording unit as the processing unit, which performs recording on a medium; and the medium transport device according to claim 7.

9. A recording apparatus comprising:

a recording unit as the processing unit, which performs recording on a medium; and the medium transport device according to claim 4.

10. A recording apparatus comprising:

a recording unit as the processing unit, which performs recording on a medium; and the medium transport device according to claim 3.

11. A recording apparatus comprising:

a recording unit as the processing unit, which performs recording on a medium; and the medium transport device according to claim 2.

12. The medium transport device according to claim 1, further comprising:

a tray state detector that detects a state of the medium receiving tray.

13. A recording apparatus comprising:

a recording unit as the processing unit, which performs recording on a medium; and the medium transport device according to claim 1.

14. The recording apparatus according to claim 13, wherein the first transport route is a transport route through which the medium is discharged, with a first surface thereof facing upward without being curved or inverted, from the processing unit to an outer side of the housing, in which the processing unit is provided, and wherein the second transport route is a transport route through which the medium processed by the processing unit is fed toward an upper side, is curved and inverted, and is discharged, with the first surface thereof facing downward, to the outer side of the housing.

15. The recording apparatus according to claim 14, wherein the recording unit includes a liquid ejecting head that performs recording on the medium by ejecting a liquid, wherein the recording apparatus further comprises a liquid containing unit that is provided on a front surface which is one of side surfaces of the housing and contains the liquid that is ejected from the liquid ejecting head, and wherein the liquid containing unit and a zone of the second transport route, in which the medium is curved and inverted, overlap each other by at least a part thereof in an apparatus depth direction.

16. The recording apparatus according to claim 15, further comprising:

a medium accommodating unit that is provided on a lower side of the first transport route and accommodates the medium; and a medium inverting unit that inverts the medium fed from the medium accommodating unit and transports the medium to the recording unit or inverts the medium, on which the recording is performed by the recording unit and which is fed back, and again transports the medium to the recording unit, wherein the medium inverting unit is provided to be close to a rear surface on a side opposite to the front surface which is one of the side surfaces of the housing.

17. A medium transport device comprising:

a first transport route for discharging a medium processed by a processing unit, with a first surface facing upward;

a second transport route for discharging the medium processed by the processing unit, with the first surface facing downward; and a medium receiving tray that is configured to switch a state between a medium receiving state of receiving the medium that is discharged through at least a part of the first transport route and a medium unreceivable state, wherein the first transport route comes into a non-formed state and at least a part of the medium receiving tray forms the second transport route when the medium receiving tray is in the medium unreceivable state, and the second transport route comes into a non-formed state and the first transport route is formed when the medium receiving tray comes into the medium receiving state, wherein the medium has the first surface facing upward when the medium is discharged onto the medium receiving tray using the first transport route, wherein the medium has the first surface facing downward when the medium is discharged using the second transport route, and wherein a state to be switched between the medium unreceivable state and the medium receiving state by sliding the medium receiving tray.

18. The medium transport device according to claim 17, wherein the medium receiving tray is provided with a projecting portion on a downstream side thereof, the projecting portion projecting from a support surface in the medium receiving tray, which supports the medium, wherein the projecting portion forms the second transport route when the medium receiving tray comes into the medium unreceivable state.

19. A recording apparatus comprising:

a recording unit as the processing unit, which performs recording on a medium; and the medium transport device according to claim 17.

20. A medium transport device comprising:

a first transport route for discharging a medium processed by a processing unit;

a second transport route for discharging a medium processed by a processing unit;

a medium receiving tray that is configured to switch a state between a medium receiving state of receiving the medium that is discharged through the first transport route and a medium unreceivable state; and a route forming member that is configured to switch a state between a first state in which the second transport route is formed and the first transport route comes into a non-formed state and a second state in which the first transport route is formed and the second transport route comes into the non-formed state, wherein the route forming member is supported by the medium receiving tray and comes into the first state when the medium receiving tray is in the medium unreceivable state, and the route forming member is released from the support by the medium receiving tray and comes into the second state when the medium receiving tray is in the medium receiving state.

* * * * *